US009870910B2

(12) United States Patent
Haufler et al.

(10) Patent No.: US 9,870,910 B2
(45) Date of Patent: Jan. 16, 2018

(54) HIGH SPEED POLARITY SWITCH TIME-OF-FLIGHT SPECTROMETER

(71) Applicant: DH Technologies Development PTE Ltd., Singapore (SG)

(72) Inventors: Robert Haufler, Toronto (CA); Martian Dima, Richmond Hill (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 15/105,099

(22) PCT Filed: Nov. 28, 2014

(86) PCT No.: PCT/IB2014/002665
§ 371 (c)(1),
(2) Date: Jun. 16, 2016

(87) PCT Pub. No.: WO2015/097507
PCT Pub. Date: Jul. 2, 2015

(65) Prior Publication Data

US 2016/0314957 A1 Oct. 27, 2016

Related U.S. Application Data

(60) Provisional application No. 61/920,563, filed on Dec. 24, 2013.

(51) Int. Cl.
*H01J 49/40* (2006.01)
*H01J 49/16* (2006.01)
*H01J 49/00* (2006.01)

(52) U.S. Cl.
CPC ..... *H01J 49/40* (2013.01); *H01J 49/0095* (2013.01)

(58) Field of Classification Search
CPC ..... H01J 49/40; H01J 49/401; H01J 49/0031; H01J 49/403; H01J 49/004; H01J 49/0095; H01J 49/025; H01J 49/063; H01J 49/027; H01J 49/0072; H01J 49/06; H01J 49/061; H01J 49/16; H01J 49/164; H01J 19/405; H01J 19/0004; H01J 49/0013;

(Continued)

(56) References Cited

U.S. PATENT DOCUMENTS 5,168,158 A * 12/1992 McComas ..... H01J 49/0013 250/282
5,614,711 A * 3/1997 Li ..... B01D 59/44 250/282

(Continued)

OTHER PUBLICATIONS

International Search Report and Written Opinion for PCT/IB2014/002665 dated Mar. 16, 2015.

*Primary Examiner* — David A Vanore

(57) ABSTRACT

A mass spectrometer and method is provided for a time-of-flight analyzer (TOF) having an accelerator stage with a plurality of electrodes to receive and accelerate a plurality of ions, and a drift chamber downstream of the accelerator stage for receiving at least a portion of the accelerated ions. The TOF analyzer also has a pulser coupled to the accelerator stage for applying one or more voltages to the plurality of electrodes and a controller coupled to the pulser to adjust one or more voltages applied to the electrodes to configure the accelerator stage to receive and accelerate positive and negative ions during different cycles of an ion detection period.

15 Claims, 28 Drawing Sheets

(58) Field of Classification Search
CPC .... H01J 49/0081; H01J 49/009; H01J 49/002; H01J 49/04; H01J 49/0431; H01J 49/0445; H01J 49/0459; H01J 49/062; H01J 49/067; H01J 49/165; H01J 49/26; H01J 49/34; H01J 49/421; H01J 49/4225; H01J 49/427; H01J 49/443; H01J 49/48; G01N 27/624; G01N 27/622; G01N 33/6848; G01N 30/7233
USPC ..... 250/281, 282, 283, 287, 286, 288, 290, 250/292, 423 R, 285, 291, 293, 396 R, 250/397, 424
See application file for complete search history.

(56) References Cited

U.S. PATENT DOCUMENTS 5,869,829 A * 2/1999 Dresch ..... H01J 49/40 250/282
6,020,586 A * 2/2000 Dresch ..... H01J 49/004 250/287
6,380,666 B1 * 4/2002 Kawato ..... H01J 49/004 250/281
6,469,296 B1 * 10/2002 Hansen ..... H01J 49/403 250/282
6,489,610 B1 * 12/2002 Barofsky ..... H01J 49/004 250/282
6,674,068 B1 * 1/2004 Kammei ..... H01J 49/025 250/282
6,700,117 B2 * 3/2004 Franzen ..... H01J 49/062 250/281
6,740,872 B1 * 5/2004 Holle ..... H01J 49/40 250/281
7,019,285 B2 * 3/2006 Dresch ..... H01J 49/401 250/287
7,126,114 B2 * 10/2006 Chernushevich ... H01J 49/0031 250/281
7,170,052 B2 * 1/2007 Furutani ..... B82Y 10/00 250/281
7,375,318 B2 * 5/2008 Kikuma ..... H01J 49/40 250/287
7,564,026 B2 * 7/2009 Vestal ..... H01J 49/025 250/287
7,759,637 B2 * 7/2010 Thomson ..... H01J 49/0072 250/282
7,902,498 B2 * 3/2011 Miller ..... G01N 27/624 250/282
7,947,950 B2 * 5/2011 Enke ..... H01J 49/40 250/281
8,187,893 B2 * 5/2012 Hunter ..... G01N 33/6848 436/173
8,384,024 B2 * 2/2013 Miller ..... G01N 27/624 250/281
8,581,178 B2 * 11/2013 Miller ..... G01N 27/624 250/282
8,890,062 B2 * 11/2014 Campbell ..... H01J 49/0072 250/285
8,957,370 B1 * 2/2015 Kyogaku ..... H01J 49/0459 250/288
8,969,798 B2 * 3/2015 Park ..... H01J 49/063 250/282
8,975,579 B2 * 3/2015 Bream ..... H01J 49/34 250/286
9,196,468 B2 * 11/2015 Campbell ..... H01J 49/165
9,214,328 B2 * 12/2015 Hoyes ..... H01J 49/403
9,378,936 B2 * 6/2016 Collings ..... H01J 49/0027
9,478,404 B2 * 10/2016 Thomson ..... H01J 49/401
9,543,138 B2 * 1/2017 Vestal ..... H01J 49/403
2010/0181474 A1 7/2010 Wang et al.
2013/0214148 A1 * 8/2013 Albeanu ..... H01J 49/0095 250/282
2015/0155153 A1 * 6/2015 Welkie ..... H01J 49/401 250/283

* cited by examiner

HIGH SPEED POLARITY SWITCH TIME-OF-FLIGHT SPECTROMETER

RELATED APPLICATION

This application claims priority to U.S. provisional application No. 61/920,563, filed on Dec. 24, 2013, which is incorporated herein by reference in its entirety.

INTRODUCTION

The present teachings are generally directed to time-of-flight ("TOF") mass spectrometry. A TOF mass spectrometer can be employed to determine the mass-to-charge ratio of ions based on the time required for the ions to travel through a field free drift region to reach a detector after constant energy acceleration.

In some cases, it is desirable to detect ions of both polarities (i.e., positively and negative charged ions) during a single run of the spectrometer. For example, it may desirable to ionize a sample under study so as to generate both positive and negative ions during analysis of that sample, and detect those ions in temporal periods that collectively constitute a single run of the spectrometer.

SUMMARY

In one aspect, a mass spectrometer is disclosed that includes a time-of-flight analyzer (TOF), which comprises an accelerator stage comprising a plurality of electrodes and adapted to receive and accelerate a plurality of ions, and a drift chamber disposed downstream of said accelerator stage for receiving at least a portion of the accelerated ions. The TOF analyzer further comprises a pulser coupled to the accelerator stage for applying one or more voltages to said plurality of electrodes, and a controller coupled to the pulser and adapted to cause the pulser to adjust said one or more voltages applied to the electrodes so as to configure the accelerator stage to receive and accelerate positive and negative ions during different cycles of an ion detection period.

In some embodiments, the pulser includes at least one positive voltage source and at least one negative voltage source and a plurality of switches for selectively coupling said voltage sources to said plurality of electrodes. The controller can selectively activate and deactivate one or more of said switches to change polarity of one or more voltages applied to said one or more electrodes so as to configure said accelerator stage from a positive ion mode to a negative ion mode.

The mass spectrometer can include an ion source adapted to provide a plurality of ions to the accelerator stage. In some embodiments, the controller is coupled to the ion source and is adapted to configure the ion source to supply positive ions to the accelerator stage when the accelerator stage is in a positive ion mode (i.e., when the accelerator stage is configured to receive and accelerate positive ions) and to supply negative ions to the accelerator stage when the accelerator stage is in a negative ion mode (i.e., when the accelerator stage is configured to receive and accelerate negative ions).

In some embodiments, the TOF analyzer comprises a first electrode, a second electrode disposed downstream of the first electrode, and a third electrode disposed downstream of the second electrode, wherein the accelerator stage is configured to receive the plurality of ions into a space between the first and second electrodes. The third electrode can be disposed in proximity of an entrance of the drift chamber.

In some embodiments, the third electrode is maintained at the ground electric potential and the controller is configured to maintain the second and third electrodes at the common ground electric potential during a first phase of a cycle for detecting positive ions so as to allow accumulation of a plurality of positive ions in a space between said first and second electrodes. During a second phase of the cycle, the controller causes the pulser to apply equal positive voltages to said first and second electrodes so as to inhibit entrance of additional positive ions into the space between the first and second electrodes. This also creates an electric field between the second and third electrodes, which is needed for acceleration of ions in the third phase of the cycle. During a third phase of the cycle, the controller causes the pulser to apply a voltage differential between the first and the second electrodes that creates an electric field that accelerates the positive ions accumulated in the space between the first and second electrodes toward the region between the second and third electrodes. The electric field created between the second and third electrodes in phase two persists in phase three. This field additionally accelerates the ions toward the drift chamber. During a fourth and final phase of the cycle in which the accelerated ions pass through the drift chamber, the controller causes the pulser to maintain the first and second electrodes at the ground electric potential. In some embodiments, the fourth phase of this cycle has a partial temporal overlap with a respective first phase of a subsequent cycle for detecting ions. In some cases, the subsequent cycle can be a cycle in which negative ions are detected. Alternatively, the respective first phase of a subsequent cycle for detecting ions can commence after termination of the fourth phase of the cycle.

In some embodiments, the third electrode is maintained at the ground electric potential and the controller is configured to maintain the second and third electrodes at the common ground electric potential during a first phase of a cycle for detecting negative ions so as to allow accumulation of a plurality of negative ions in a space between said first and second electrodes. During a second phase of the cycle, the controller causes the pulser to apply equal negative voltages to said first and second electrodes so as to inhibit entrance of additional negative ions into the space between the first and second electrodes. This also creates an electric field between the second and third electrodes, which is needed for acceleration in the third phase of the cycle. During a third phase of the cycle, the controller causes the pulser to apply a voltage differential between the first and the second electrodes, which creates an electric field that accelerates the negative ions accumulated in the space between the first and second electrodes toward the region between the second and third electrodes. Between the second and third electrodes, the field created in phase two persists in phase three. This field additionally accelerates the ions toward the drift chamber. During a fourth and final phase of the cycle in which the accelerated ions pass through the drift chamber, the controller causes the pulses to maintain the first and second electrodes at the ground electric potential. In some embodiments, the fourth phase of this cycle has a partial temporal overlap with a respective first phase of subsequent cycle for detecting ions. Alternatively, a respective first phase of a subsequent cycle can commence after the termination of the fourth phase. In some cases, the subsequent cycle can be a cycle in which positive ions are detected.

The TOF analyzer can include an ion detector disposed downstream of the drift chamber for detecting the ions (or at least a portion thereof) that have passed through the drift chamber. In some embodiments, an ion deflector is disposed downstream of the accelerator stage so as to deflect the accelerated positive and negative ions along different trajectories for passage through at least a portion of the drift chamber. In some such embodiments, a positive ion mirror is disposed downstream of the ion deflector and is configured to receive the positive ions from the deflector and reflect those ions toward the ion detector. Further, a negative ion mirror is disposed downstream of the deflector and is configured to receive the negative ions from the deflector and to reflect the negative ions toward the ion detector.

In some embodiments, the TOF analyzer can include a positive ion mirror and a negative ion mirror disposed in tandem downstream of the accelerator stage so as to reflect the accelerated positive and negative ions along different trajectories toward the ion detector. This embodiment may also be configured such that the tandem mirrors reflect the positive and negative ions in such a way that the ions of both polarities follow the same trajectory toward the detector.

In a related aspect, a TOF mass spectrometer is disclosed, which comprises an accelerator stage for receiving a plurality of ions, where the accelerator stage comprises a plurality of electrodes. A pulser is configured to alternatingly switch polarity of voltages applied to one or more of said electrodes so as to alternatingly place said accelerator stage in a positive ion mode and a negative ion mode.

In some embodiments, either of a positive or a negative ion mode includes a first phase for accepting a plurality of ions into the accelerator stage, a second phase in which no additional ions are accepted into the accelerator stage and the ions that have accumulated in the accelerator stage experience no electric field, a third phase in which ions accumulated in the accelerator stage are deflected and accelerated into a field-free drift region of the TOF spectrometer, and a fourth phase in which the electrodes of the accelerator stage are maintained at the ground electric potential and the ions pass through the drift region to be detected by a detector of the spectrometer.

In some embodiments, the TOF spectrometer further comprises an ion deflector disposed downstream of said accelerator stage for receiving the accelerated ions, where the deflector angularly separates the positive and negative ions onto a positive and a negative ion path, respectively. A positive ion reflector disposed downstream of the ion deflector receives the positive ions propagating along said positive ion path and reflects the ions toward an ion detector of the spectrometer. A negative ion reflector disposed downstream of the ion deflector receives the negative ions propagating along said negative ion path and reflects those ions toward the ion detector.

In another aspect, a method of performing mass spectroscopy using a TOF analyzer is disclosed, which comprises configuring an accelerator stage of the analyzer to receive and accelerate positive and negative ions during different cycles for detecting positive and negative ions, respectively. During each cycle, the accelerated positive or negative ions are passed through a field-free drift chamber. At least a portion of the ions that have passed through the drift chamber are detected by an ion detector.

In some embodiments, at least one cycle for detecting positive ions has a partial overlap with at least one cycle for detecting negative ions. In some embodiments, the step of configuring the accelerator stage comprises switching the polarity of one or more voltages applied to one or more electrodes of the accelerator. In some embodiments, at least one mass spectrum of a plurality of positive ions and at least one mass spectrum of a plurality of negative ions are obtained within a time period in a range of about 10 microseconds to about 500 microseconds, e.g., within a time period less than about 100 microseconds.

Further understanding of various aspects of the invention can be obtained by reference to the following detailed description in conjunction with the associated drawings, which are described briefly below.

DETAILED DESCRIPTION

Figure 1A:
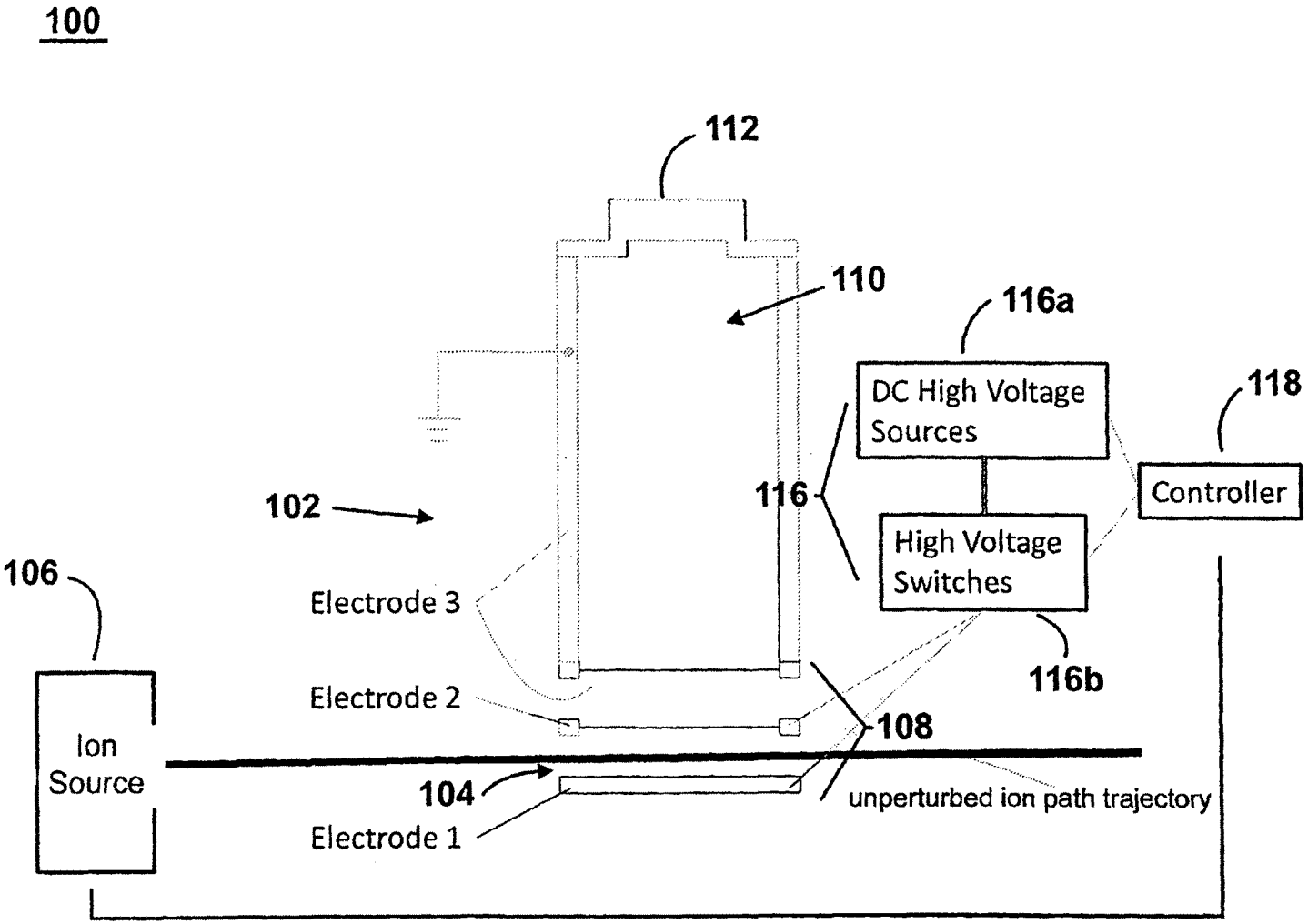
FIG. 1A schematically depicts a mass spectrometer according to an embodiment of the present teachings, FIG. 1B schematically depicts various components of a TOF analyzer of the mass spectrometer of FIG. 1A, FIG. 1C schematically depicts a controller of the mass spectrometer of FIG. 1A controls a pulser (including high voltage sources and switches) for selectively applying voltages to the electrodes of the accelerator stage of the TOF analyzer, FIG. 1D schematically depicts exemplary internal hardware of the controller, FIG. 2 schematically depicts the arrangement of voltage sources and switches in a pulser suitable for use in the practice of the invention, FIG. 3 indicates the states (open or closed) of the switches of the pulser shown in FIG. 2 for different phases of a cycle for detecting positive ions, FIG. 4 indicates the states (open or closed) of the switches of the pulser shown in FIG. 2 for different phases of a cycle for detecting negative ions, FIG. 5A schematically depicts an ion detection period that comprises one cycle for detecting positive ions and one cycle for detecting negative ions, FIG. 5B schematically depicts alternating cycles of positive and negative ion detection, FIG. 5C schematically depicts two ion detection periods, each of which includes five cycles of positive and five cycles of negative ion detection, FIG. 5D schematically depicts two ion detection periods, each of which includes seven cycles of positive and three cycles of negative ion detection, FIG. 5E schematically depicts two ion detection periods, each of which includes two cycles of positive and eight cycles of negative ion detection, FIG. 5F schematically depicts the temporal arrangement of the positive and negative cycles in another embodiment, FIG. 6 schematically depicts the arrangement of voltage sources and switches in another pulser suitable for use in the practice of the invention, FIG. 7 schematically depicts the states (open or closed) of the switches of the pulser shown in FIG. 6 for different phases of a cycle for detecting positive ions, FIG. 8 indicates the states (open or closed) of the switches of the pulser shown in FIG. 6 for different phases of a cycle for detecting negative ions, FIG. 9 schematically depicts the arrangement of voltage sources and switches in another pulser suitable for use in the practice of the invention, FIG. 10 schematically depicts the states (open or closed) of the switches of the pulser shown in FIG. 9 for different phases of a cycle for detecting positive ions, FIG. 11 schematically depicts the states (open or closed) of the switches of the pulser shown in FIG. 9 for different phases of a cycle for detecting negative ions, FIG. 12 schematically depicts the arrangement of voltage sources and switches in another pulser suitable for use in the practice of the invention, FIG. 13 schematically depicts the states (open or closed) of the switches of the pulser shown in FIG. 12 for different phases of a cycle for detecting positive ions, FIG. 14 schematically depicts the states (open or closed) of the switches of the pulser shown in FIG. 12 for different phases of a cycle for detecting negative ions, FIG. 15 schematically depicts the arrangement of voltage sources and switches in another pulser suitable for use in the practice of the invention, FIG. 16 schematically depicts the states (open or closed) of the switches of the pulser shown in FIG. 15 for different phases of a cycle for detecting positive ions, FIG. 17 schematically depicts the states (open or closed) of the switches of the pulser shown in FIG. 15 for different phases of a cycle for detecting negative ions, FIG. 18 schematically depicts a TOF analyzer according to another embodiment of the present teachings, FIG. 19 schematically depicts a TOF analyzer according to another embodiment of the present teachings, and FIG. 20 schematically depicts a TOF analyzer according to another embodiment, which includes an ion mirror that can be configured to function as a positive or negative ion mirror in synchrony with the positive and negative mode of the analyzer's accelerator.

The present invention provides a mass spectrometer that is capable of detecting ions of both charge polarities (i.e., positive and negative ions) within an ion detection period. The duration of the period can be short so as to make a TOF spectrometer a nearly simultaneous positive and negative ion detector. For example, the timescale of the period can be much shorter than the timescale corresponding to other relevant events, such as changing of the ion source polarity. In some embodiments, the spectrometer includes a time-of-flight (TOF) analyzer that is configured to provide nearly concurrent detection of the positive and negative ions. In some embodiments, the ionization may switch rapidly from positive to negative during a run, which would require the TOF mass spectrometer to be capable of rapidly switching from a positive mode to a negative mode. Some of the reasons for desiring such a capability can be to save time and sample by obviating the need for performing two analytical runs: one of positive and one for negative ions. In some embodiments, the time-of-flight (TOF) analyzer includes an acceleration stage comprising a plurality of electrodes to which interleaving positive and negative voltages can be applied to accelerate positive ions during one portion of an ion detection period and negative ions during another portion of the ion detection period to a field-free drift chamber to be detected by an ion detector. An ion source can supply ions to the TOF analyzer. A controller can control the ion source, which is configured to receive a sample for mass spectroscopic analysis, so that the source would provide positive and negative ions, e.g., via ionization of the sample, during different portions of an ion detection cycle. The controller can also adjust one or more voltages applied to one or more electrodes of the accelerator such that the TOF is configured for detection of positive ions during the time intervals in which the ion source generates positive ions and for detection of negative ions during the time intervals in which the ion source generates negative ions.

The various terms are used herein consistent with their ordinary meanings in the art. For further clarity, certain terms are described below.

The term "positive ions" refers to ions having a net positive electric charge. The term "negative ions" refers to ions having a net negative electric charge. The term a "cycle" or "ion detection cycle" is used to refer to a time period during which a batch of ions enter the TOF analyzer and are detected by a detector of the analyzer. The term "a detection period" refers to a plurality of ion detection cycles that temporally follow one another, and can be repeated over time. For example, in the embodiments discussed below, an ion detection period can include one or more cycles for detecting positive ions and one or more cycles for detecting negative ions. The term "positive ion mode" refers to an operating mode of the TOF analyzer in which the analyzer is configured for the detection of positive ions and the term "negative ion mode" refers to an operating mode of the TOF analyzer in which the analyzer is configured for the detection of negative ions. Furthermore, the terms "ion reflector" and "ion mirror" are used interchangeably according to their common meanings in the art to refer to a device configured to reverse the direction of travel of an ion in a mass spectrometer. The term "pulser" as used herein refers to a device suitable for applying voltages to the electrodes of the accelerator stage. A pulser typically includes a plurality of voltage sources, e.g., high voltage sources, and switches, e.g., high speed (rise time less than 1 microsecond)/high voltage switches.

Figure 1B:
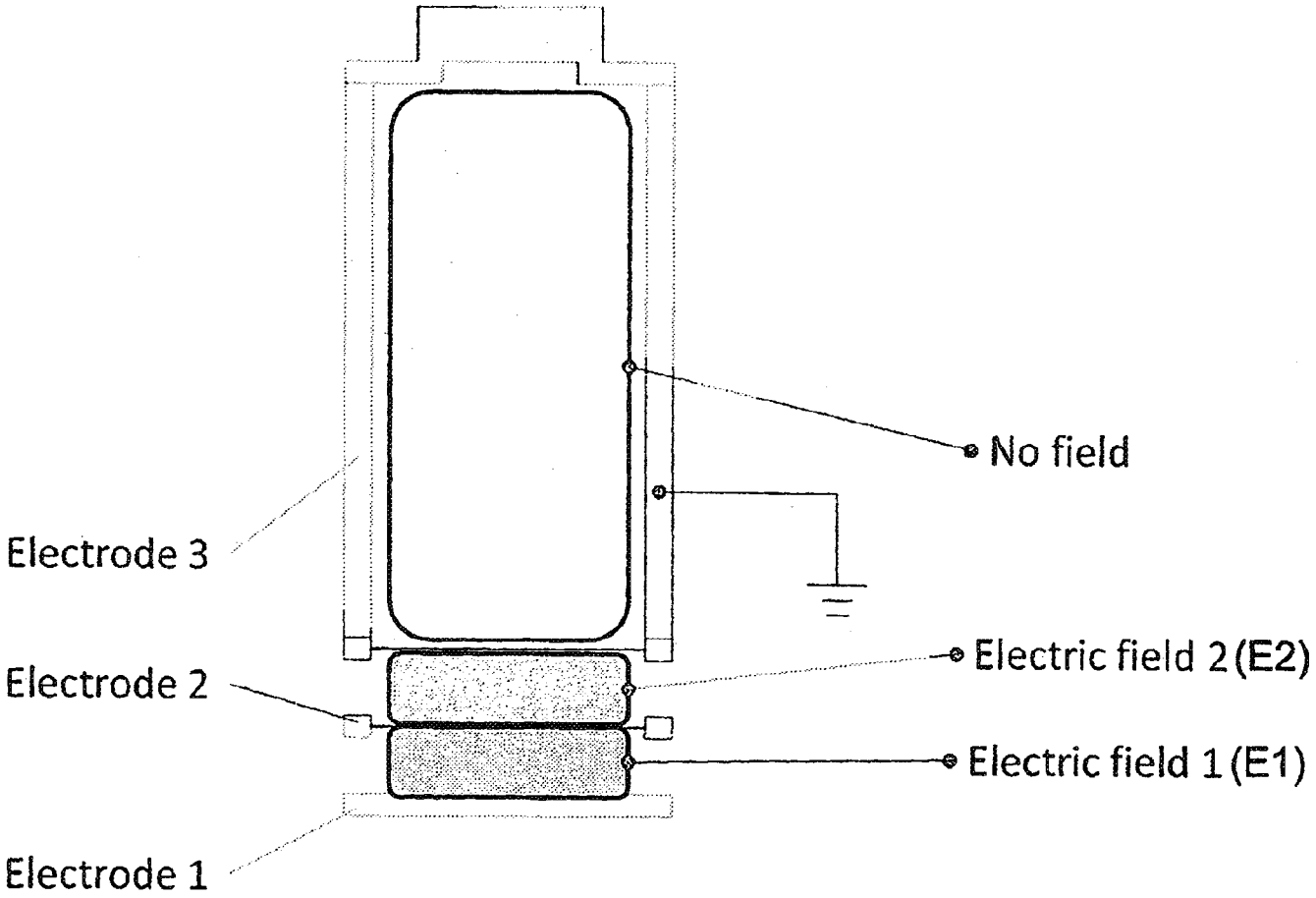
Figure 1C:
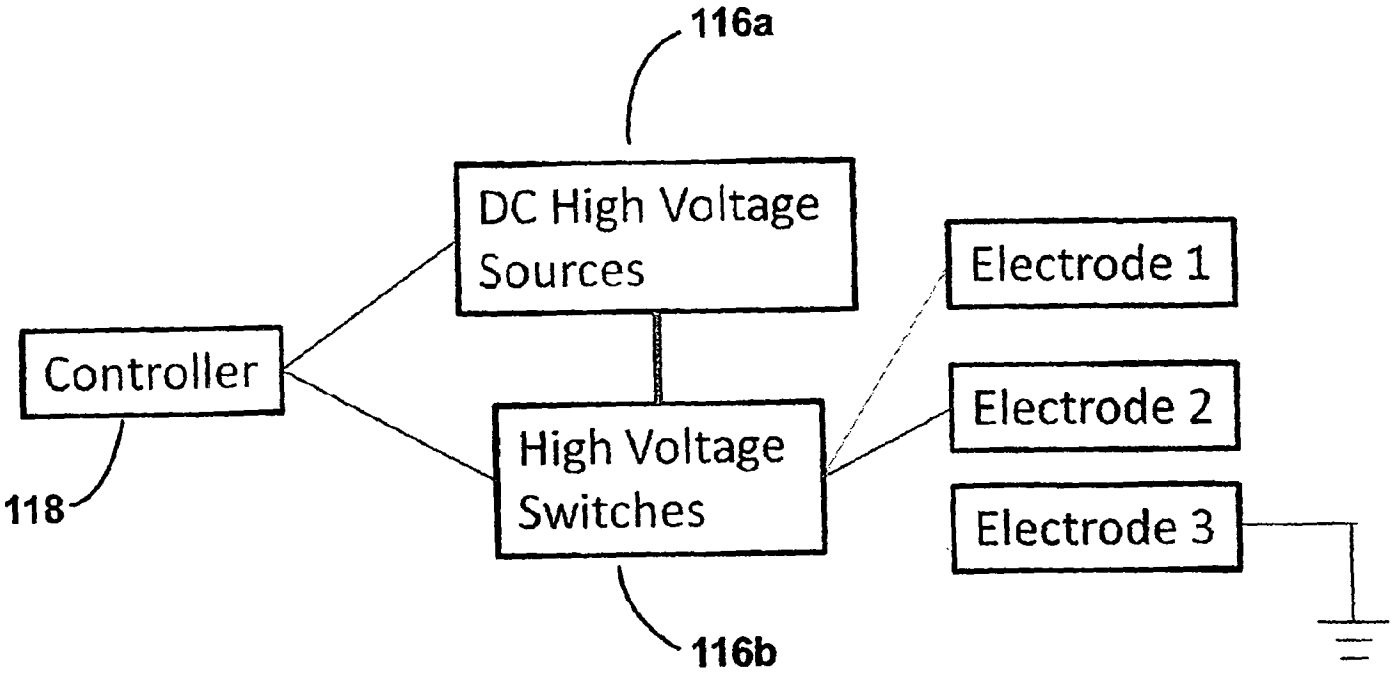

FIGS. 1A, 1B, and 1C schematically show an embodiment of a mass spectrometer 100 according to the applicant's teachings having a time-of-flight (TOF) analyzer 102 that includes an orifice (aperture) 104 for receiving ions from an upstream unit 106, which is an ion source in this embodiment. The ion source 106 may be a pulsed or continuous flow ion source. Some examples of suitable ion sources include, without limitation, an electrospray ionization ("ESI") source, a desorption electrospray ionization ("DESI") source, or a sonic spray ionization ("SSI") source, among others. In other cases, the TOF spectrometer 100 can receive ions that have undergone various stages of filtering, fragmentation, and/or trapping.

The exemplary TOF 102 further includes an acceleration stage 108 for accelerating and directing the ions entering the mass analyzer into a field-free drift chamber 110, as discussed in more detail below. After passage through the field-free drift chamber, an ion detector 112 receives the ions for detection. As the time required for ions to pass through the field-free chamber to reach the detector depends on their mass-to-charge (m/z) ratios, the ion detection signals generated by the detector can be employed to generate a mass spectrum. In this embodiment, the detector output is grounded so that a transimpedance amplifier can be incorporated close to the detector, rather than passing the signal to high voltage transformers. In this way, the dynamic range of the detector, and the transfer bandwidth can be improved, and the overall jitter can be reduced by amplifying a shorter ground referenced signal, together with lower detector bias voltage and hence increased detector life. In some embodiments, a multiple ion collector configuration (e.g., 16 anode collectors) may also be used for increased sensitivity. The grounding of the liner of drift chamber and the output of the detector provides certain advantages. For example, it avoids the problem of detecting a signal with a few millivolts amplitude on top of many kV DC voltage when the detector is floated.

The acceleration stage comprises three electrodes 1, 2, and 3. In this embodiment, the electrode 1 is a solid plate having a central orifice (not shown) through which ions can pass, and the electrode 2 is in the form of a grid through which ions can pass. The electrode 3 is also in the form of a grid and is electrically coupled to a shield or liner 114 of the drift chamber 110 (in other words, the electrode 3 and the liner form a single electrode having a front portion in the form of a grid through which the ions enter the drift chamber). In this embodiment, the electrode 3 and the liner 114 are maintained at the ground electric potential. As shown schematically in FIG. 1B and discussed in more detail below, in certain phases of a cycle for detecting ions, voltage pulses can be applied to electrodes 1 and 2 to generate an electric field (E1) in a region between electrodes 1 and 2 and an electric field (E2) between the electrodes 2 and 3. As discussed in more detail below, the applied voltage pulses are configured such that in certain phases of an ion detection cycle the ions accumulated in a space between electrode 1 and 2 are accelerated toward the field-free drift chamber.

With continued reference to FIGS. 1A and 1C, the mass spectrometer further includes a pulser 116 that operates under the control of a system controller 118 to supply voltage pulses to the electrodes 1 and 2 in accordance with the present teachings. The controller 118 also controls the ion source so as to configure the source (e.g., by adjusting the polarity of one or more voltages employed in the ions source) so as to supply positive and negative ions to the analyzer when the accelerator is in a positive ion mode and negative ion mode, respectively. Further, in some embodiments, the controller can communicate with the detector 112, e.g., to receive ion detection signals and generate a mass spectrum based on those signals.

The controller can include any suitable software, hardware and firmware for controlling the pulser 116, the source 106 and communicating with the detector 112, as discussed in more detail below. By way of example, the controller can determine the magnitude of high voltages applied to the electrodes of the accelerator, the state of switches (e.g., transistor switches) of the pulser, and the timing of the state changes of those switches.

Figure 1D:
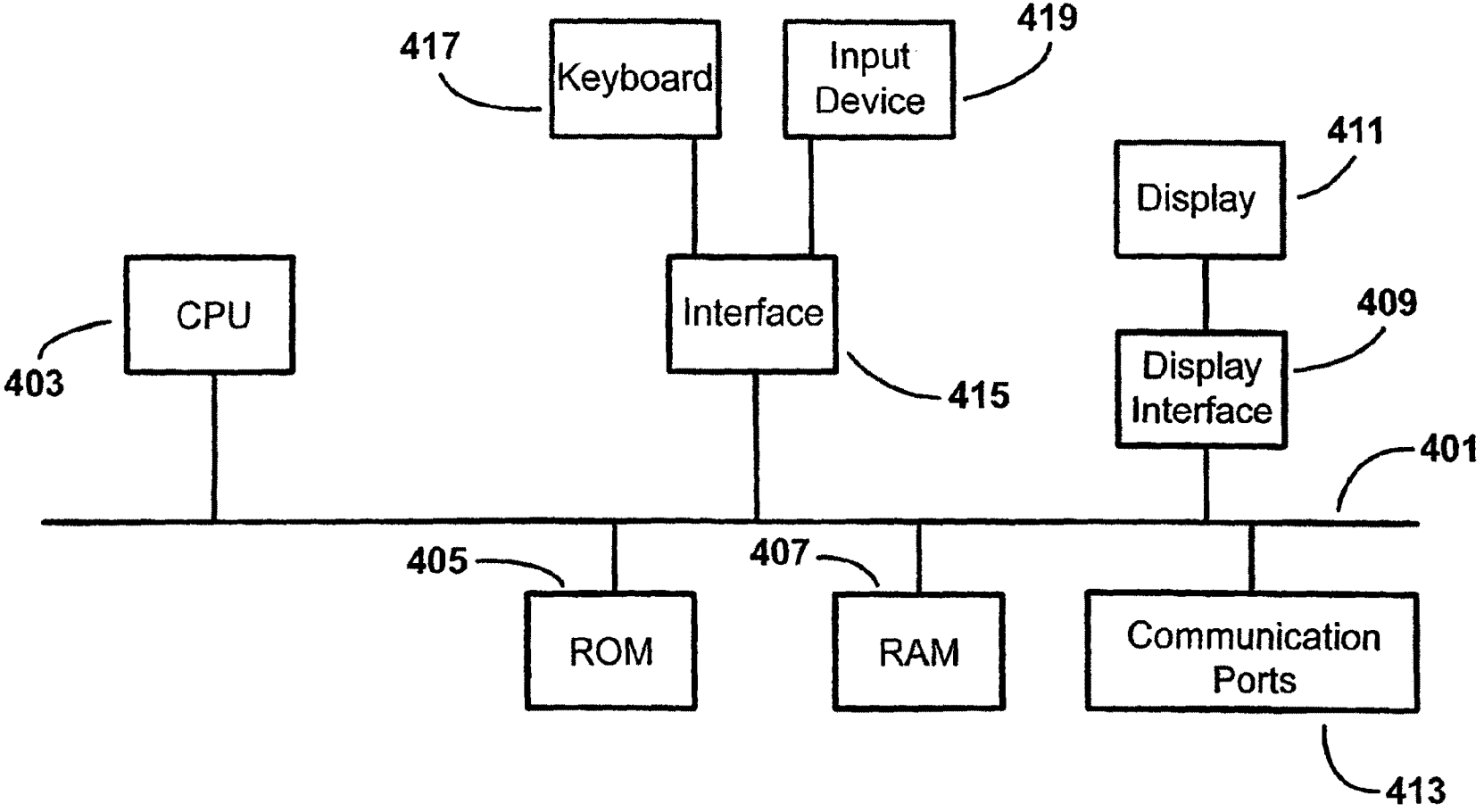

By way of further illustration, FIG. 1D depicts a block diagram of exemplary internal hardware that may be used to contain or implement the controller 118. A bus 401 interconnects the other illustrated components of the hardware. A central processing unit (CPU) 403 performs calculations and logic operations required to execute a program. The program, for example, can include instructions for controlling the pulser (e.g., closing and opening various switches of the pulser to apply positive and negative voltages to the electrodes of the accelerator stage), the ion source, and the detector in accordance with the present teachings. The exemplary controller 118 further includes Read only memory (ROM) 405 and random access memory (RAM) 407, which can be utilized to store the program instructions.

An optional display interface 409 may permit information from the bus 401 to be displayed on the display 411 in audio, visual, graphic or alphanumeric format. Communication with external devices, such as the pulser, may occur using various communication ports 413.

The hardware may also include an interface 415, which can allow the receipt of data from input devices such as a keyboard 417 or other input device 419 such as a mouse, a joystick, a touch screen, a remote control, a pointing device, a video input device and/or an audio input device.

With reference to FIG. 1A, in this embodiment, the pulser 116 includes a plurality of DC high voltage sources 116*a* (e.g., voltage sources capable of generating voltages between about 1 kV to about 20 kV) as well as a plurality of high voltage switches 116*b* for selectively applying voltages generated by these sources to the electrodes. As noted above, the system controller 118 can include any suitable software, hardware and firmware for controlling the voltage sources and switches of the pulser 116. By way of example, the controller 118 can determine the magnitude of the high voltages applied to the electrodes, the state of switches (e.g., transistor switches) and the timing of the state changes of those switches, among other parameters.

In this embodiment, the controller and the pulser, including the high voltage sources and switches, are disposed outside of the analyzer vacuum chamber while the electrodes are disposed inside the vacuum chamber. A plurality of low voltage control wires can electrically connect the controller to the voltage sources and the switches, and a plurality of high voltage wires can connect the high voltage sources to the switches. The electrodes can be connected to the switches via high voltage wires and high voltage vacuum feedthroughs. In some embodiments, the entire field-free drift chamber and the pulser power supply electronics are maintained at the same temperature to achieve high mass accuracy.

In this embodiment, in use, the positive and the negative ions are detected during different detection cycles of a detection period. As discussed in more detail below, each detection cycle of the positive or negative ions can include multiple phases, including, an ion acceptance phase, an ion preparation phase, an ion acceleration phase followed by the detection of the ions.

For example, during an initial ion acceptance phase (herein referred to as phase 1) of an ion detection cycle, the electrodes 1, 2, and 3 are maintained at the ground electric potential, and a plurality of ions enter the TOF analyzer through the aperture 104 into the region between the electrodes 1 and 2 without any perturbation to the ion trajectories.

In a subsequent ion preparation phase (herein also referred to as phase 2), the electrodes 1 and 2 are maintained at the same positive or negative voltages and the electrode 3 is maintained at the ground electric potential. By way of example, the positive or negative voltages can have a magnitude value in a range of about 1 to about 20 kV. The voltages applied to the electrodes 1 and 2 are selected so as to prevent the entry of additional ions into the accelerator and to create the second acceleration field between electrodes 2 and 3. The ions that are already present in the region between electrodes 1 and 2 do not experience any electric field and continue along their initial trajectories.

In a subsequent ion acceleration phase (herein referred to as phase 3), electrodes 1 and 2 are maintained at different voltages and the electrode 3 is maintained at the ground potential. The electrode 1 is maintained at a voltage required to generate an electric field between electrodes 1 and 2 that can cause the ions (e.g., positive ions during one cycle of a detection period and negative ions during another cycle of the detection period) to change their trajectory and accelerate toward electrode 2. The electrode 2 is maintained at the same voltage as in the previous phase to produce the required electric field between the electrodes 2 and 3. During this phase, ions cannot enter the accelerator and the ions already in the region between the electrodes 1 and 2 are accelerated out of the accelerator into the field-free drift chamber 110. In some embodiments, the voltage differential between these two electrodes 1 and 2 during the acceleration phase can be, e.g., in a range of about 1 to about 10 kV.

Subsequently, in an ion detection phase (herein referred to as phase 4), the ions that have entered the field-free chamber 110 pass through the chamber and are detected by the ion detector 112. During this phase, the electrodes 1, 2, and 3 are maintained at the ground potential. In some embodiments, this phase can have a temporal overlap with the ion acceptance phase of the subsequent ion detection cycle. In other words, as the accelerated ions pass through the drift chamber, a new batch of ions can be introduced into the accelerator, i.e., between the space between the electrodes 1 and 2. Alternatively, the ion acceptance phase of the next cycle can commence after completion of the ion detection phase (phase 4).

Figure 2:
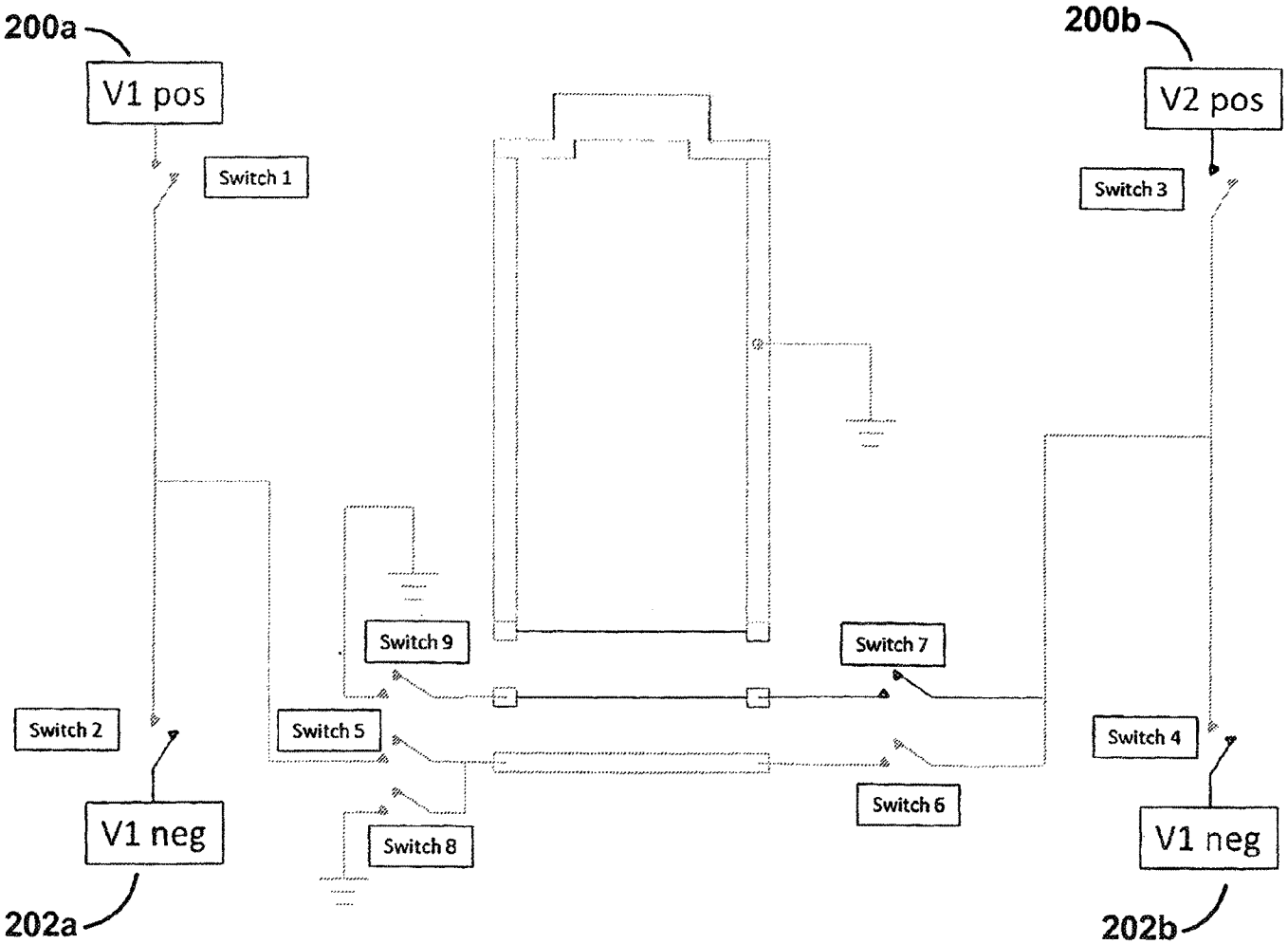

FIG. 2 schematically depicts an embodiment of the pulser 116, which includes positive voltage sources 200*a* and 200*b*, and negative voltage sources 202*a* and 202*b*, and a plurality of high voltage switches labeled as Switches 1-9. In this embodiment, the switches can be implemented by employing high voltage (e.g., MOSFET) transistors in a manner known in the art, though in other embodiments other technologies can be employed.

Figure 3:
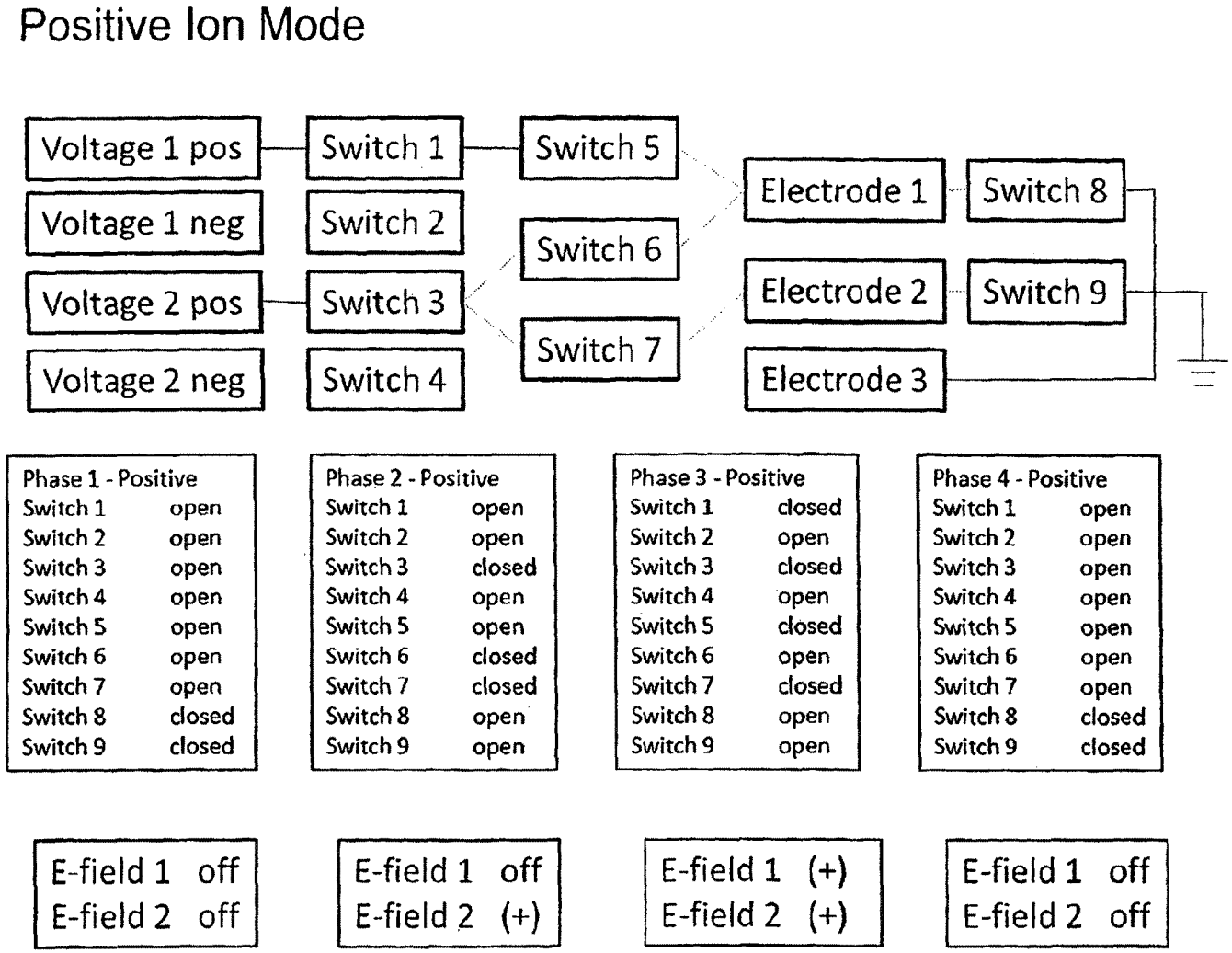

With reference to FIG. 3, during phase 1 of positive ions detection cycle, the switches 8 and 9 are closed and the other switches are open to maintain the electrodes 1 and 2 at the ground electric potential (as indicated above, the electrode 3 is maintained at the ground potential during the four phases of a detection cycle). During phase 2, the switches 3, 6 and 7 are closed and the other switches are open so as to apply the same positive voltage (namely V2) to the electrodes 1 and 2 while the electrode 3 is maintained at the ground electric potential. As noted above, these voltages deter the entry of additional positive ions into the region between the electrodes 1 and 2. During phase 3, the switches 1, 3, 5 and 7 are closed and the other switches are open so as to apply positive voltage V1 to the electrode 1 and positive voltage V2 to the electrode 2. The voltage differential between the electrodes 1 and 2 in this phase causes the positive ions to change their trajectory and be accelerated toward the field-free drift chamber (See, e.g., FIG. 1A). During the detection phase, the electrodes 1 and 2 are maintained at the ground potential by employing the same switching arrangement utilized in phase 1. During this phase, the accelerated ions pass through the field-free drift chamber and are detected by the ion detector.

Figure 4:
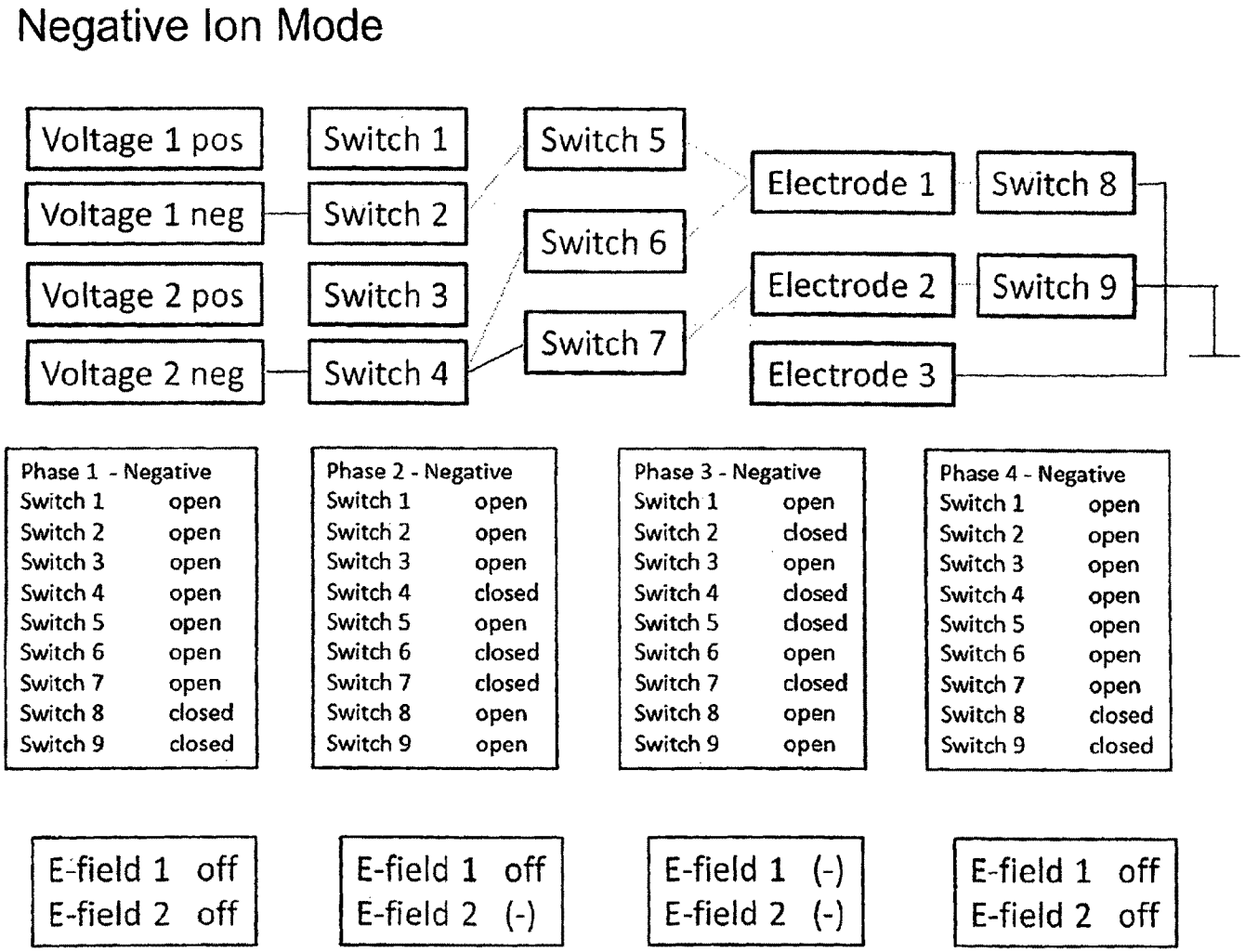

With reference to FIG. 4, during phase 1 of negative ions detection cycle, the switches 8 and 9 are closed to maintain the electrodes 1 and 2 at the ground electric potential, and the other switches are open (as indicated above, the electrode 3 is maintained at the ground potential during the four phases of a detection cycle) to generate a field-free region between the electrodes. As noted above, during this phase, ions enter the region between the electrodes 1 and 2. During phase 2, the switches 4, 6 and 7 are closed and the other switches are open so as to apply the same negative voltage (namely V2) to the electrodes 1 and 2 while the electrode 3 is maintained at the ground electric potential. The application of the same negative voltages to the electrodes 1 and 2 results in a field-free region between the electrodes 1 and 2 and the generation of an electric field between the electrodes 2 and 3. As noted above, these voltages deter the entry of additional negative ions into the region between the electrodes 1 and 2. During phase 3, the switches 2, 4, 5 and 7 are closed and the other switches are open so as to apply negative voltage V1 to the electrode 1 and negative voltage V2 to the electrode 2. The voltage differential between the electrodes 1 and 2 results in generation of an electric field in the region between the electrodes 1 and 2 as well as in the region between the electrodes 2 and 3, which deflect and accelerate the negative ions toward the drift chamber. During the detection phase of the cycle, the electrodes 1 and 2 are maintained at the ground potential by employing the same switching arrangement as that utilized in phase 1. During this phase, the accelerated ions pass through the field-free drift chamber and are detected by the ion detector. As noted above, in some embodiments, the ion acceptance phase of the subsequent ion detection cycle can have a temporal overlap with the ion detection phase or can commence after the termination of the ion detection phase.

Figure 5A:
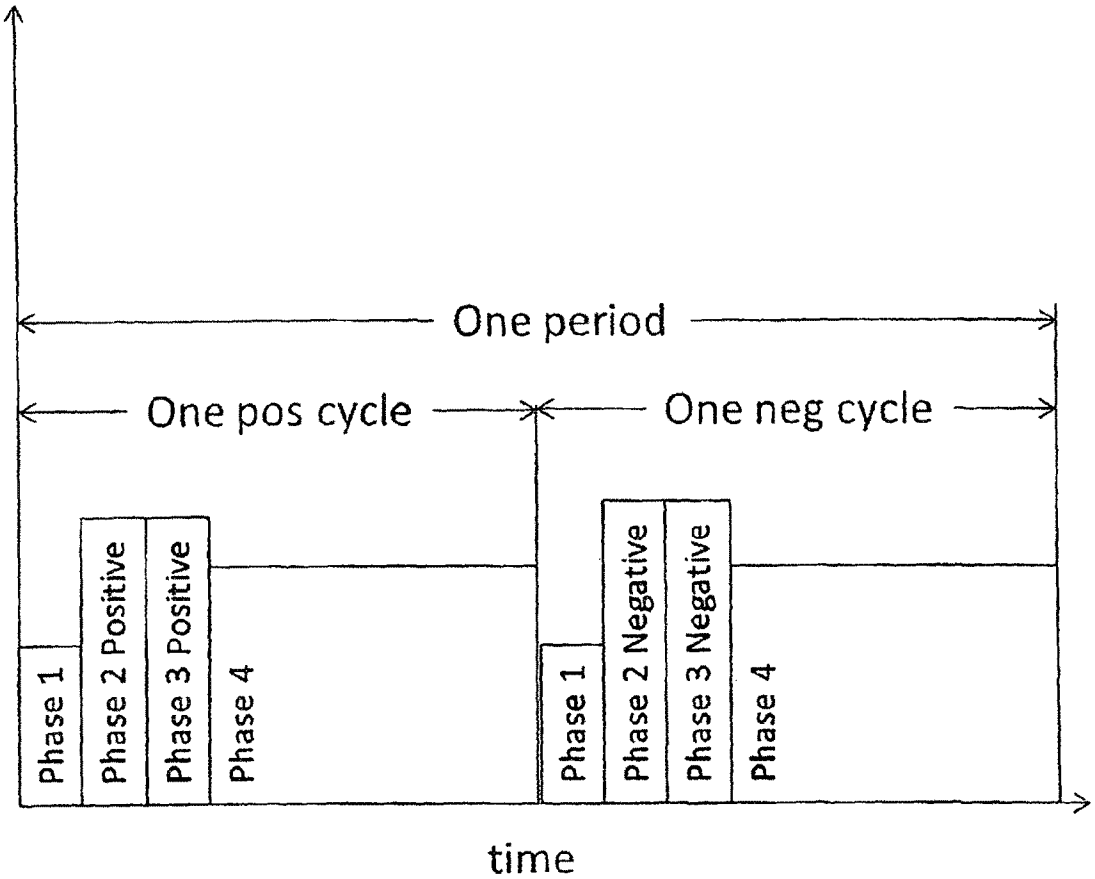
Figure 5B:
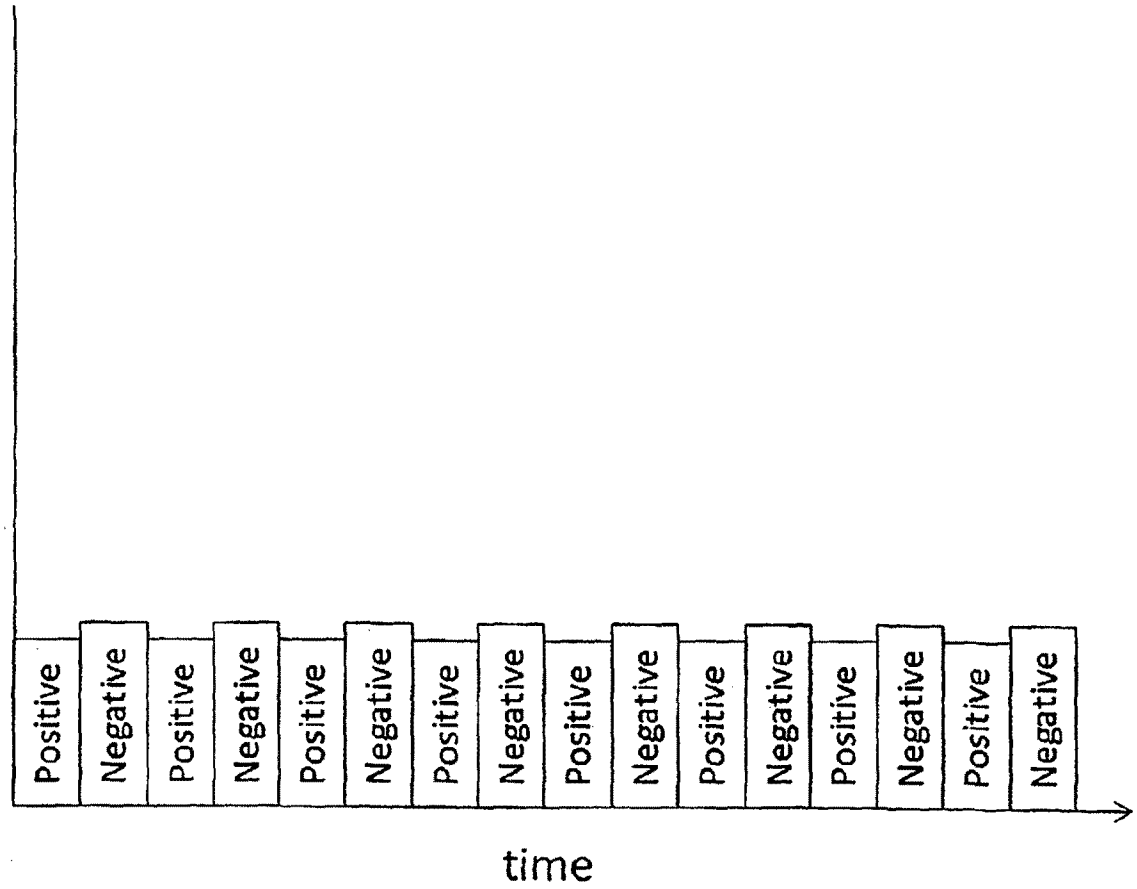
Figure 5C:
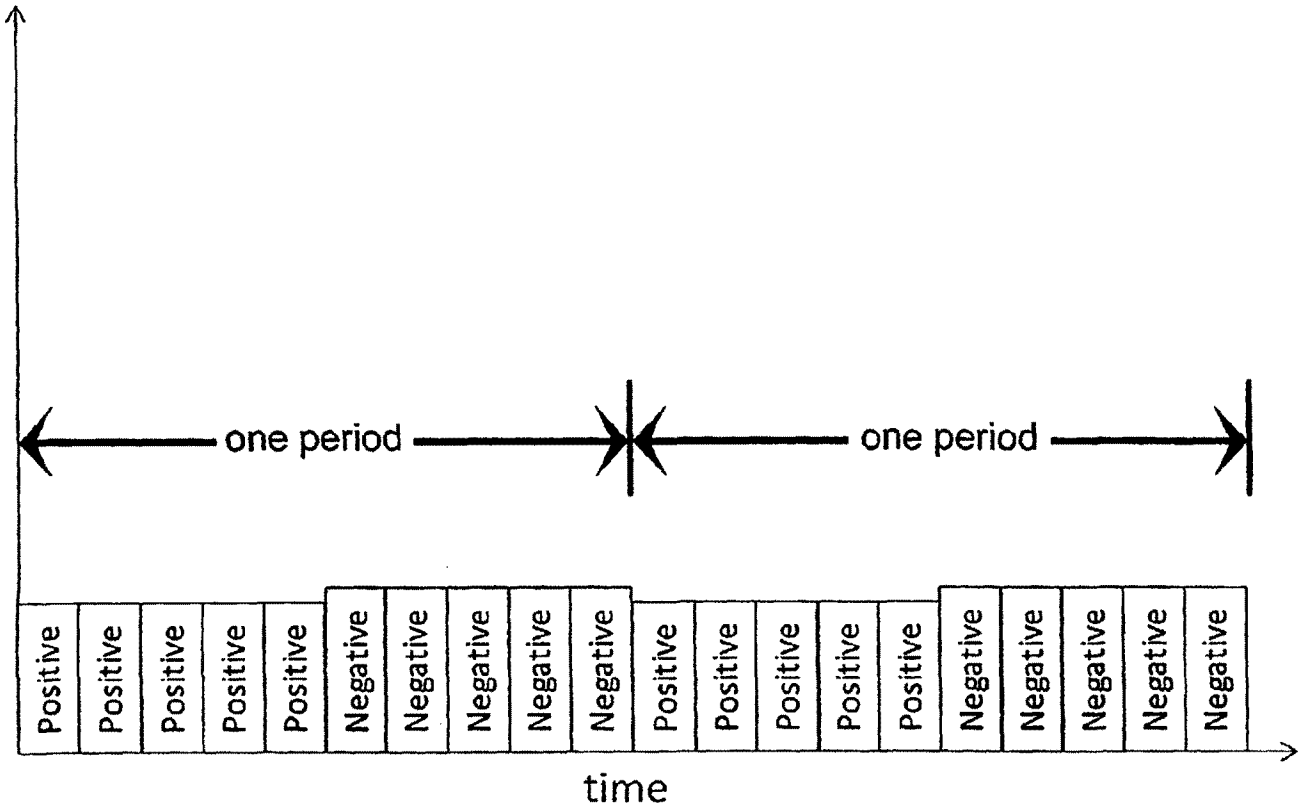

The cycles for detecting positive and the negative ions can be arranged so as to obtain a desired ratio of positive and negative cycles within a detection period. A detection period as used herein refers to a set of positive and negative detection cycles, which can be repeated in time. By way of example, FIG. 5A shows a detection period that includes one cycle for detecting positive ions and one cycle for detecting negative ions. In other words, in this example, the time spent detecting positive and negative ions is equal. Although in this example the phase 1 of the negative cycle is shown to start after completion of the phase 4 of the positive cycle, in some cases, there is a temporal overlap between phase 1 of the negative cycle and phase 4 of the positive cycle. FIG. 5B shows multiple periods where the cycles alternate between positive and negative ion modes. Equal times are spent observing positive and negative ions. In other embodiments, other temporal arrangements of positive and negative detections cycles can be employed. By way of illustration, FIG. 5C depicts an embodiment in which five consecutive positive cycles and five consecutive negative cycles form a period of ion detection. This may be advantageous if the timescale of the switching from positive to negative is much shorter (e.g., by a factor of 10 or more) than other events, for example, switching the polarity of the ion source.

Figure 5D:
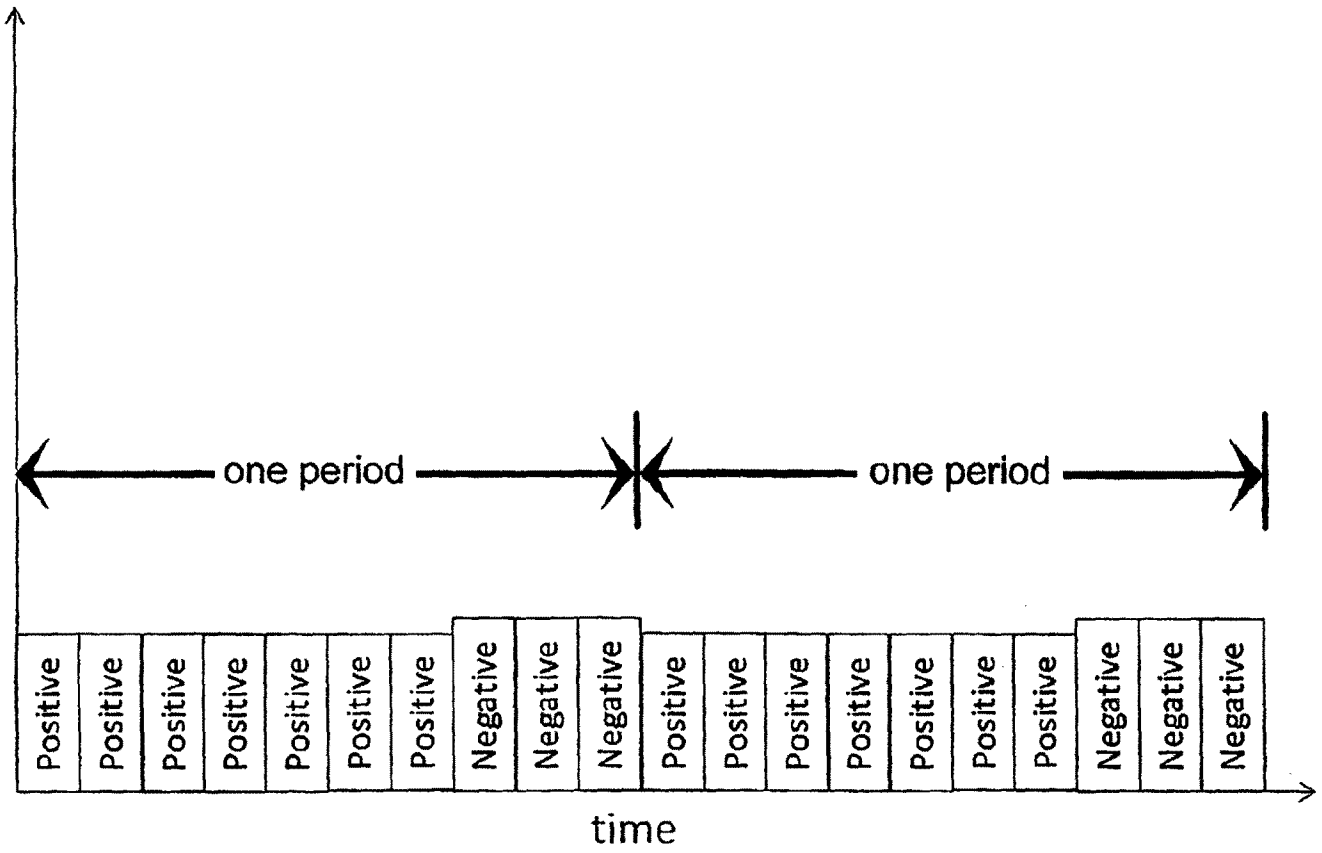
Figure 5E:
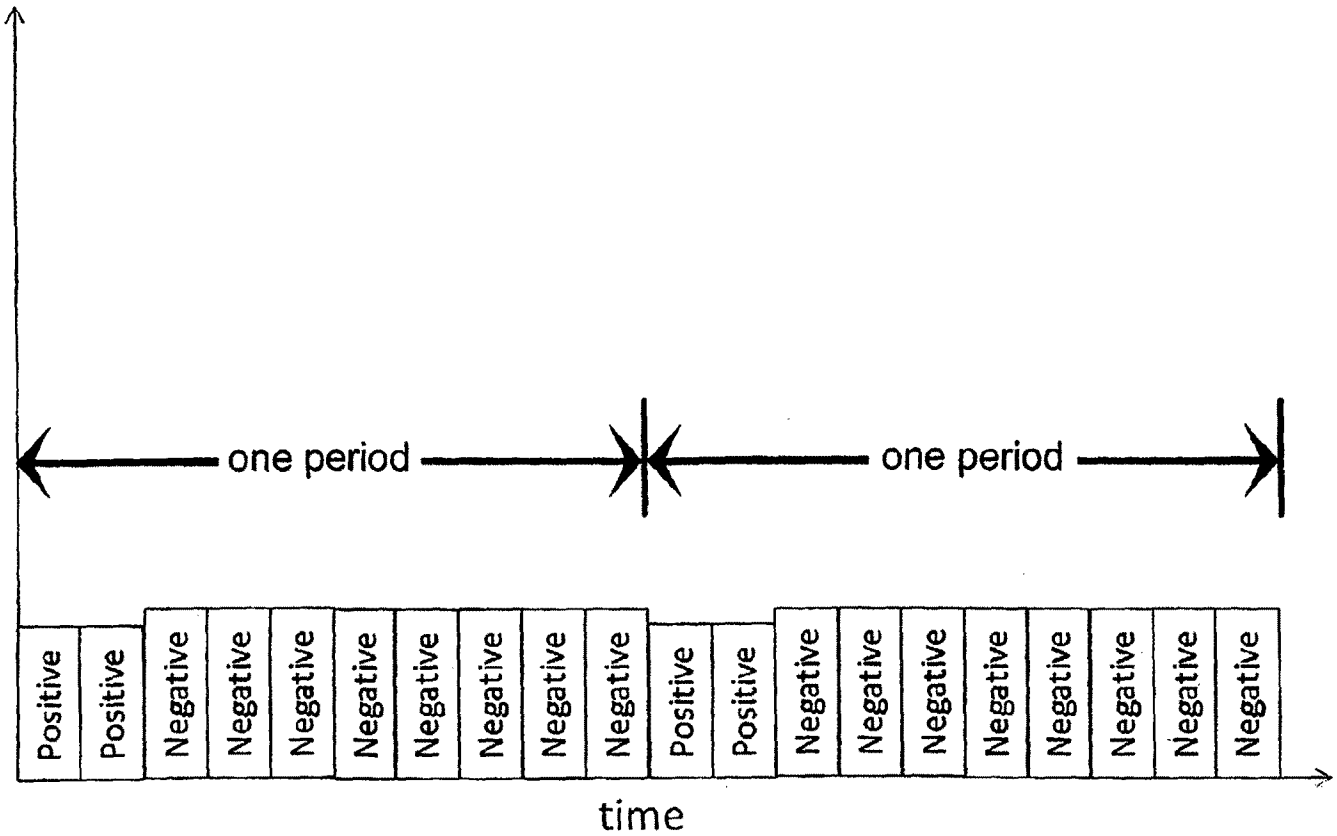
Figure 5F:
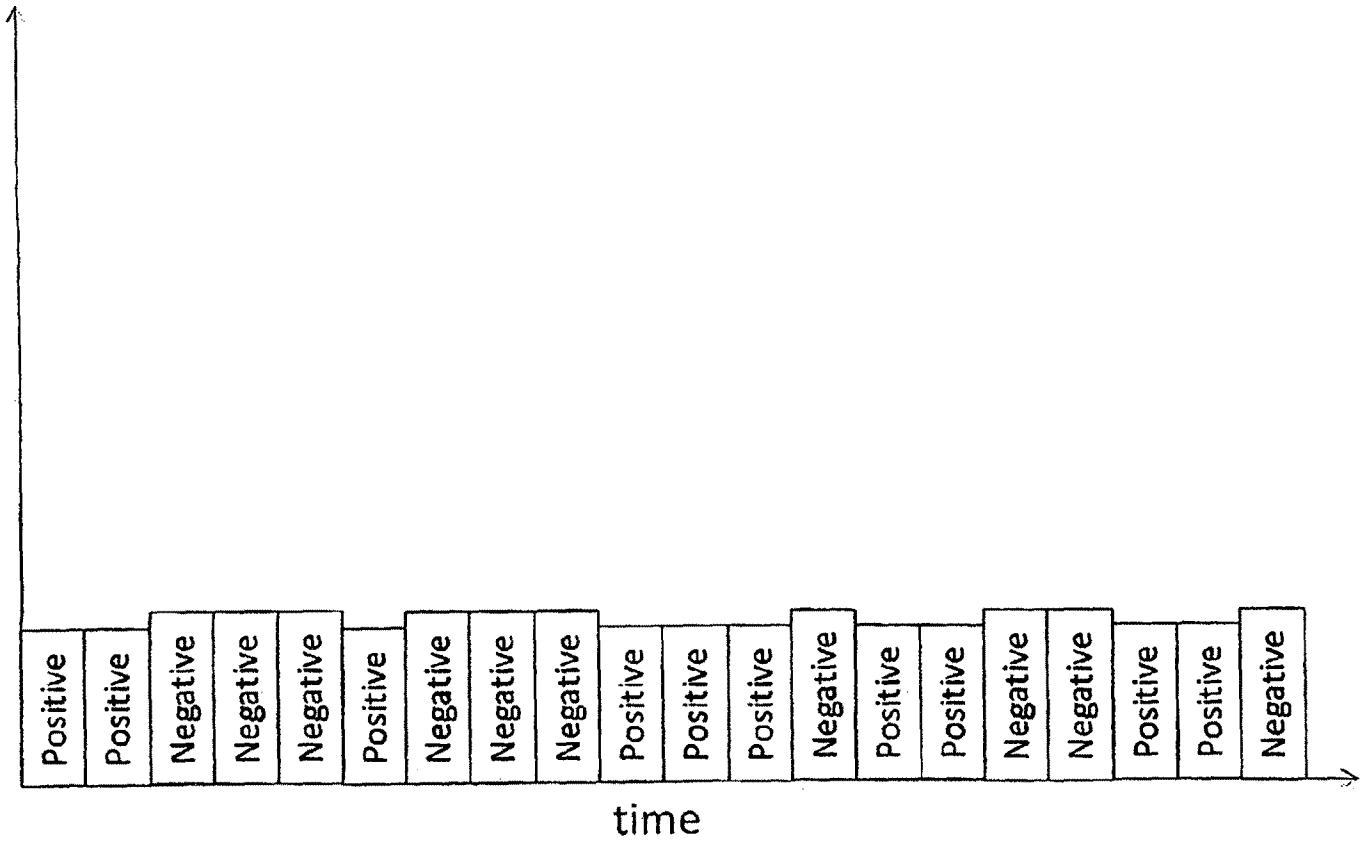

In some embodiments, it may be desirable to have more positive or more negative cycles within a detection period. For example, consider a sample under analysis that may be expected to generate more negative ions than positive ions. By way of example, FIG. 5D shows one such embodiment in which a period of ion detection includes seven positive cycles and three negative cycles. In this case, positive ions are less frequently observed than negative ions. By increasing the ratio of positive cycles to negative cycles, the observance of either positive or negative ions will be more evenly balanced. Since the ratio will be known, the final counts can be scaled to represent the presence of positive and negative ions in the sample post acquisition. FIG. 5E shows an arrangement of positive and negative cycles in another embodiment in which two positive cycles and eight negative cycles constitute one period of ion detection. By way of further illustration, FIG. 5F shows the temporal arrangement of the positive and negative cycles in another embodiment. In FIG. 5F, the ratio of the positive and negative cycles varies over time. This arrangement may be useful, for example, where the ratio of the number of positive ions to negative ions also varies over time, and the system is operated to obtain the instantaneous optical ratio of positive to negative cycles.

Figure 6:
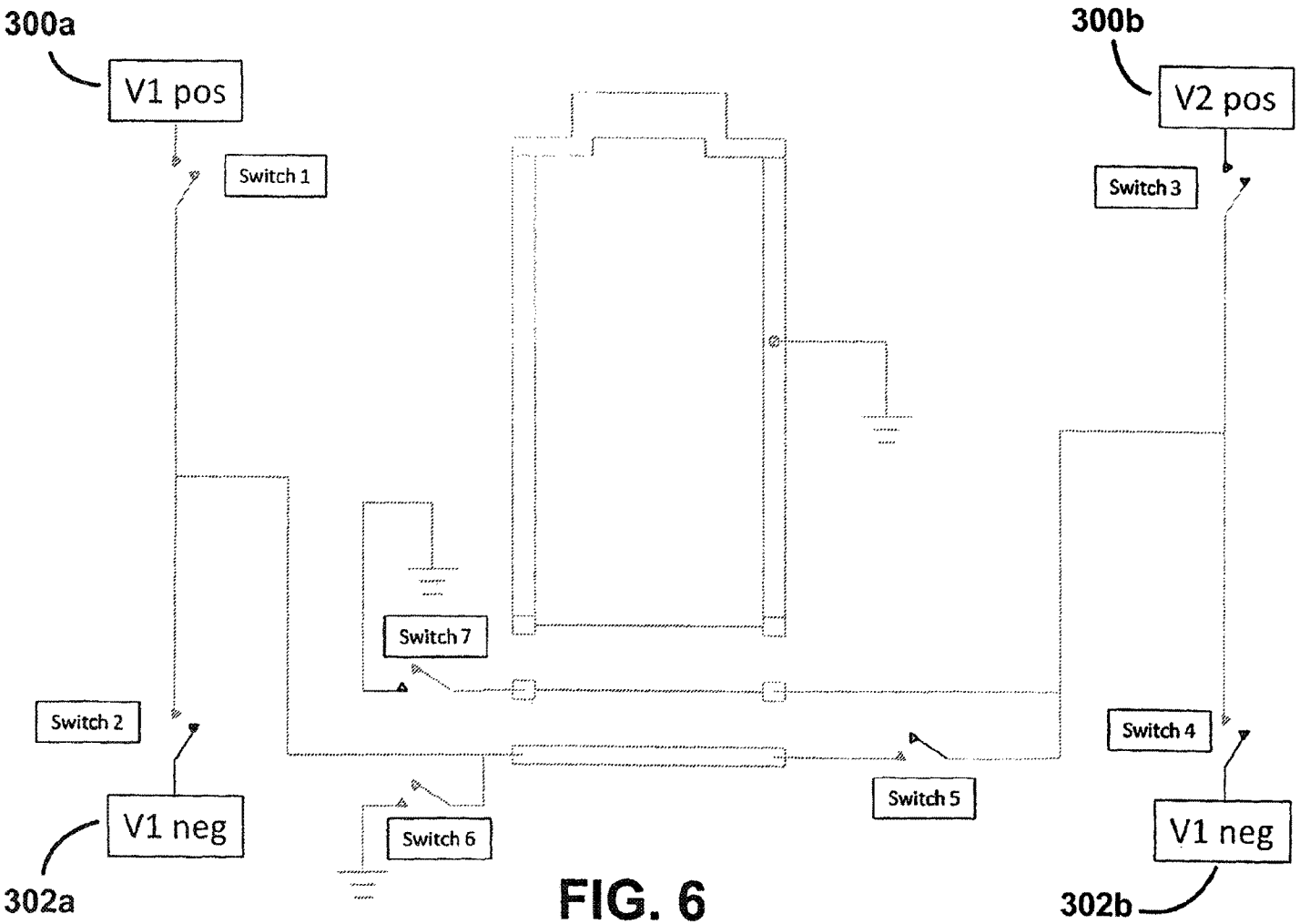
Figure 7:
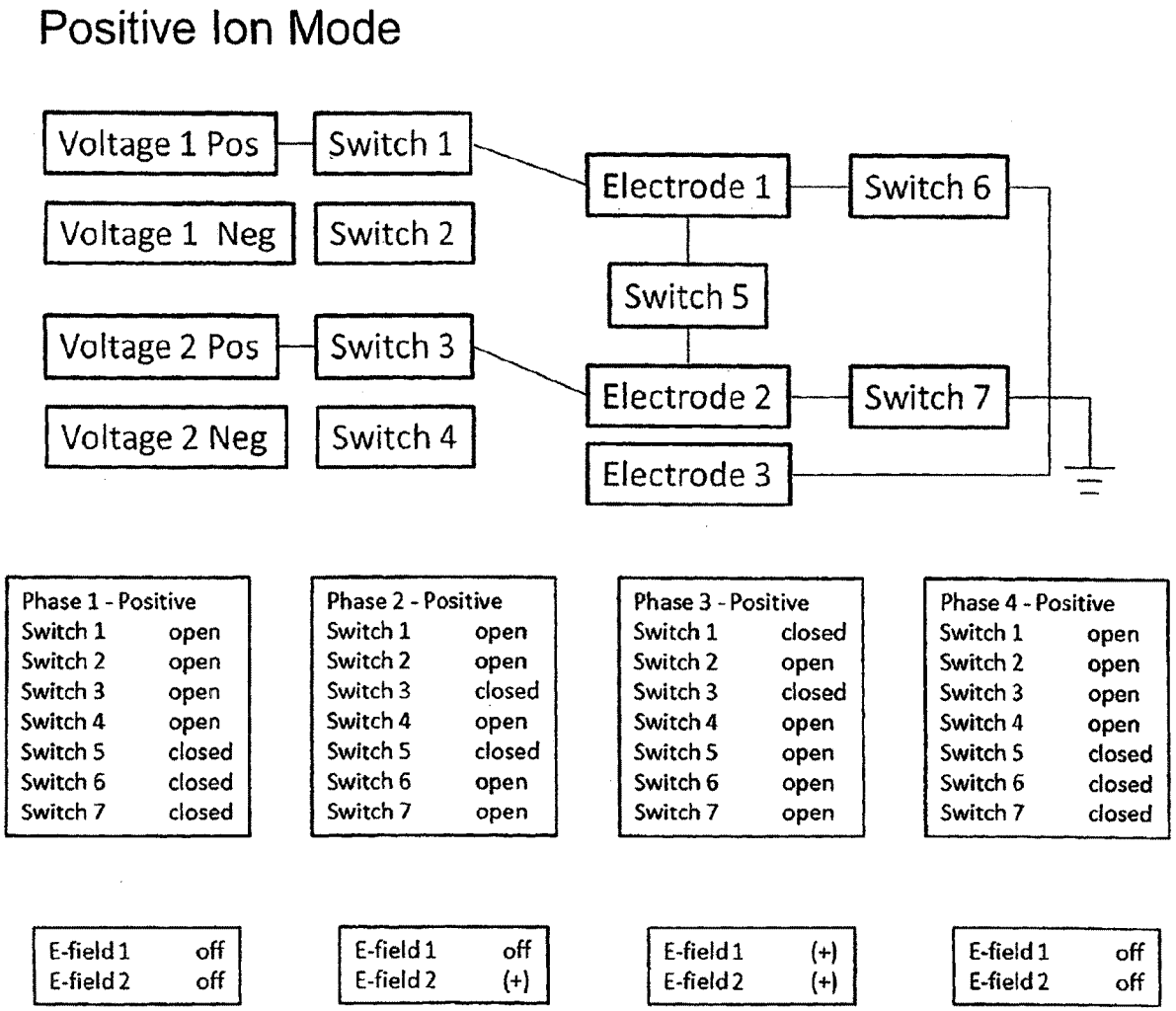

The number and arrangement of switches that can be employed in a pulser for practicing the present teachings are not limited to those discussed above. By way of example, FIG. 6 schematically depicts a pulser according to another embodiment that includes positive and negative voltages sources 300*a*, 300*b*, 302*a*, and 302*b* as well as seven switches, labeled as Switch 1 through Switch 7. With reference to FIG. 7, in this embodiment, during phase 1 of positive ions detection cycle, switches 5, 6 and 7 are closed and the other switches are open so as to maintain the electrodes 1 and 2 at the ground electric potential (again, the electrode 3 is maintained at the ground potential throughout an ion detection cycle). Switch 5 may be open in phase 1. During phase 2, the switches 3 and 5 are closed and the other switches are open so as to apply the same positive voltage (i.e. positive V2) to the electrodes 1 and 2, which results in a field free region between the electrodes 1 and 2 and the generation of an electric field in the region between electrodes 2 and 3. During phase 3, the switches 1 and 3 are closed and the other switches are open so as to apply different positive voltages to the electrodes 1 and 2 (i.e., positive V1 to electrode 1 and positive V2 to electrode 2). As discussed above, this voltage differential creates an electric field that causes the ions to deflect and accelerate toward the drift chamber. During phase 4, the switches 5, 6, and 7 are closed and the other switches are open to ensure that all the three electrodes are at the ground electric potential.

Figure 8:
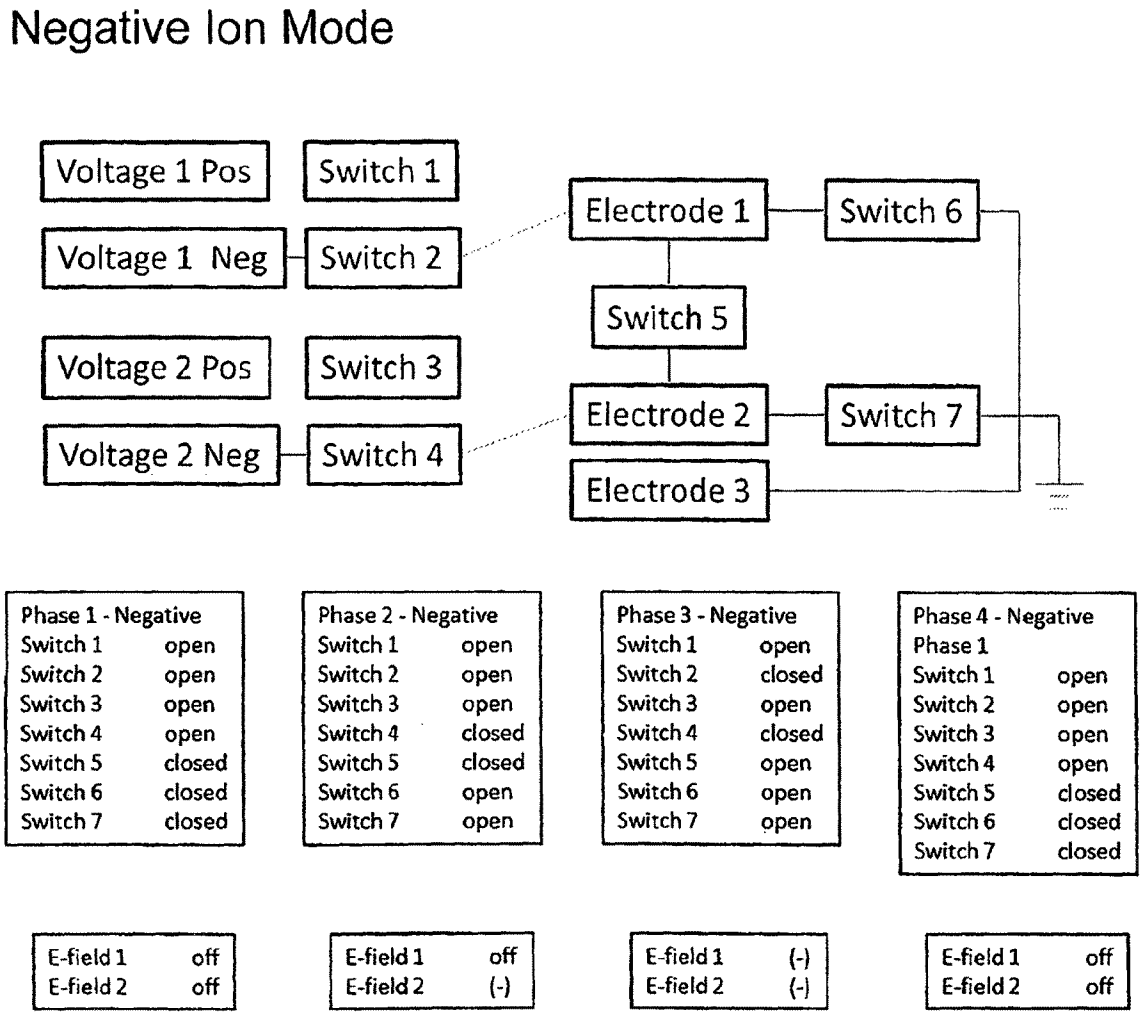

With continued reference to FIGS. 6 and 8, during phase 1 of a cycle for detecting negative ions, the switches 5, 6 and 7 are closed and the other switches are open, to maintain the three electrodes at the ground electric potential. Switch 5 may be open in phase 1. During phase 2, the switches 4 and 5 are closed and the other switches are open to apply the same negative potential (i.e., negative V1) to the electrodes 1 and 2. During phase 3, the switches 2 and 4 are closed to apply a voltage differential across the electrodes 1 and 2 for deflecting and accelerating the negative ions toward the field-free drift chamber. During phase 4, the switches 5, 6 and 7 are closed and the other switches are open so as to maintain the three electrodes at the ground electric potential.

Figure 9:
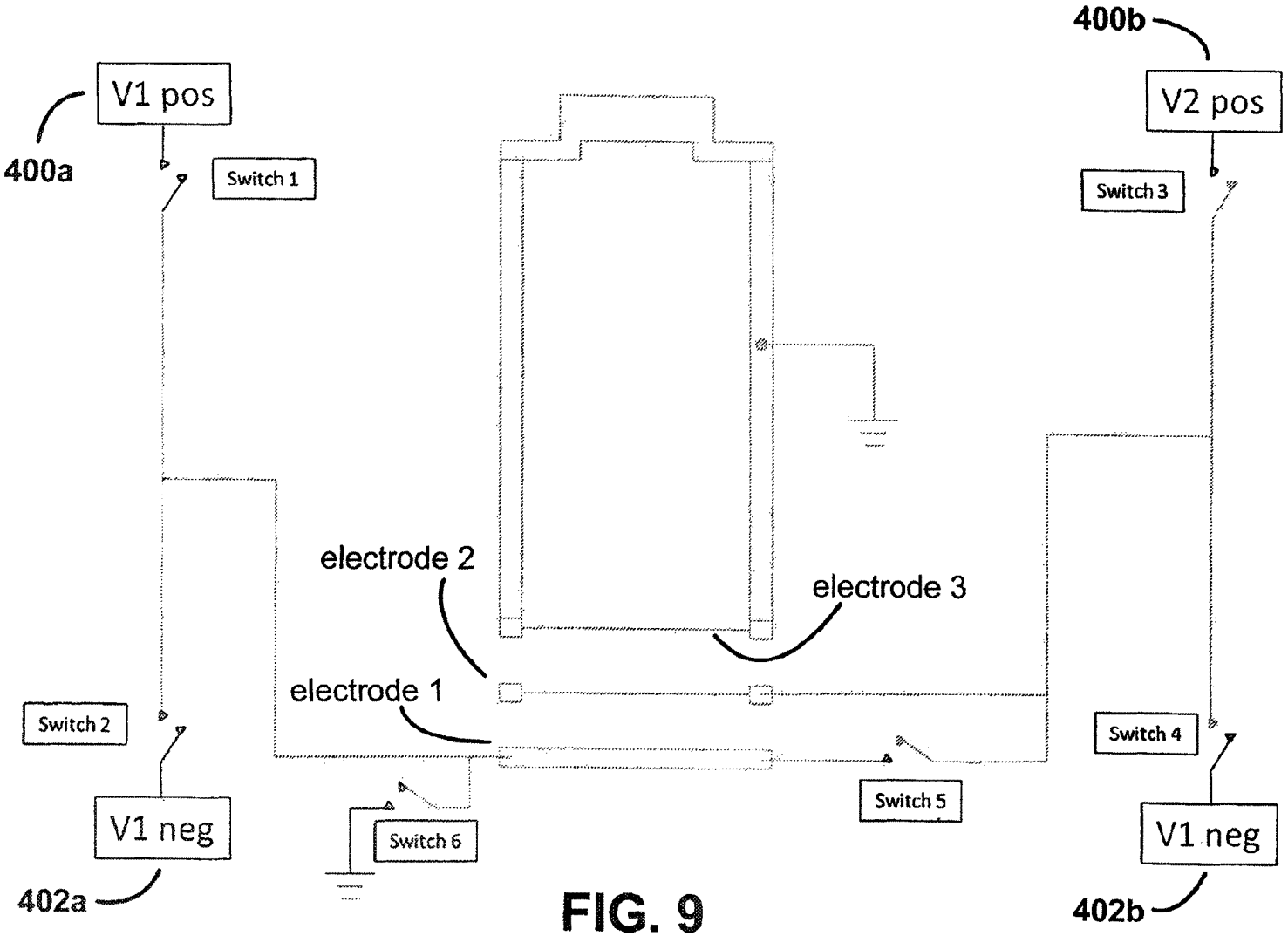
Figure 10:
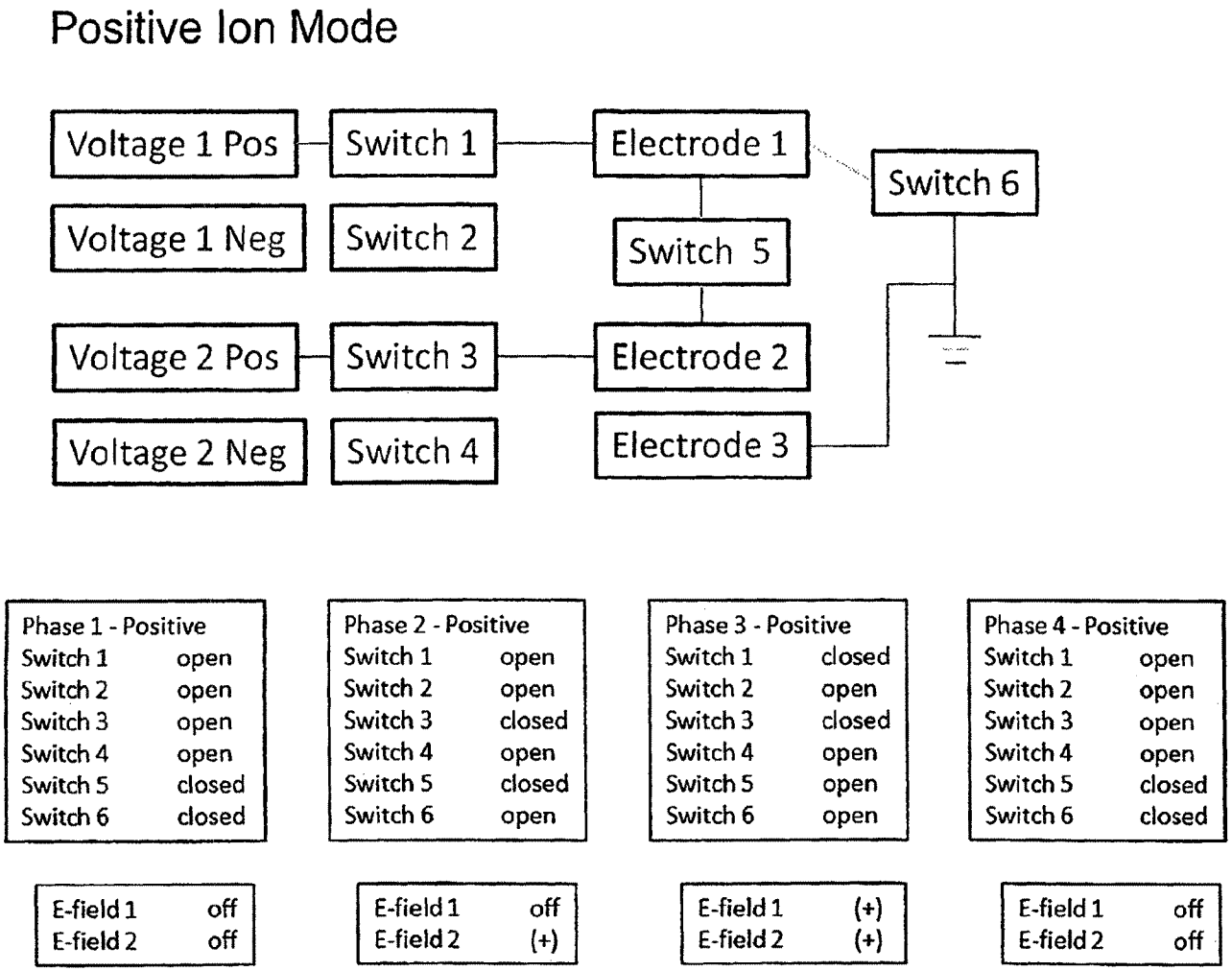

With reference to FIG. 9, in another embodiment, the pulser can include positive voltage sources 400*a*, 400*b*, and negative voltage sources 402*a*, and 402*b*, and can employ 6 switches to apply different voltages to the electrodes 1, 2 during various phases of a cycle for detecting positive or negative ions. More specifically, with reference to FIG. 10, during phase 1 of a cycle for detecting positive ions, the switches 5 and 6 are closed and the other switches are open to couple the electrodes to the electric ground. During phase 2 of such a cycle, the switches 3 and 5 are closed and the other switches are open to apply the same positive voltage (i.e., positive V2) to the electrodes 1 and 2. During phase 3 of the cycle, the switches 1 and 3 are closed and the other switches are open to apply a voltage differential to the electrodes 1 and 2 to deflect and accelerate the ions within the space between the electrodes 1 and 2 to the field-free drift chamber. During phase 4 of the cycle, the switches 5 and 6 are closed and the other switches are open to maintain each of the three electrodes at the common electric ground potential.

Figure 11:
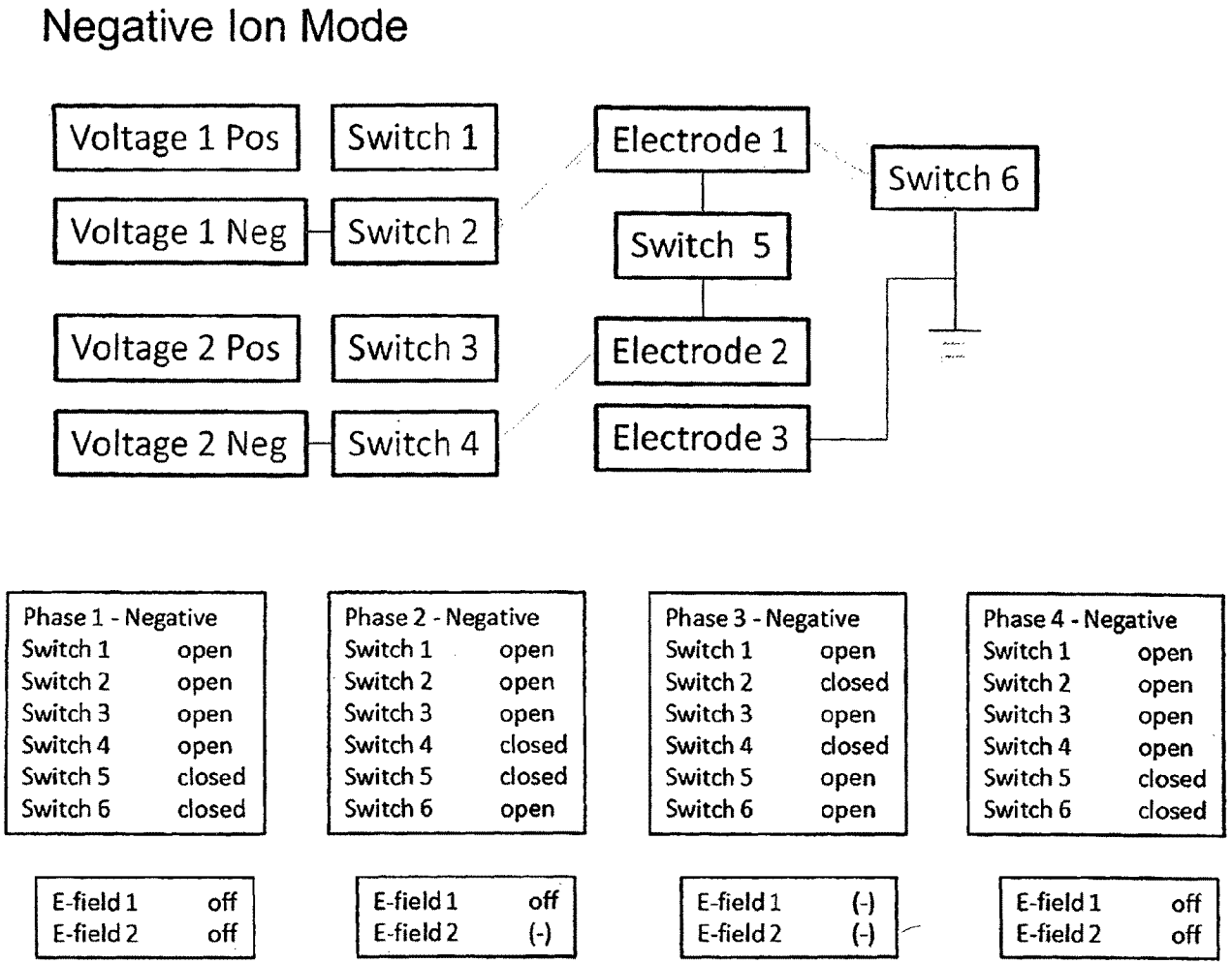

With reference to FIG. 9 as well as FIG. 11, during phase 1 of a cycle for detecting negative ions, the switches 5 and 6 are closed and the other switches are open so as to maintain each of the electrodes 1, 2 and 3 at the common electric ground. During phase 2, the switches 4 and 5 are closed and the other switches are open so as to apply the same negative voltage (i.e., negative V1) to the electrodes 1 and 2 to prevent the entry of additional ions into the space between the electrodes 1 and 2, as discussed above. During phase 3, the switches 2 and 4 are closed and the other switches are open so as to apply a voltage differential across the electrodes 1 and 2 to deflect and accelerate the ions accumulated in the space between the electrodes 1 and 2 toward the drift chamber. During phase 4, the switches 5 and 6 are closed and the other switches are open to maintain each of the three electrodes at the ground electric potential.

Figure 12:
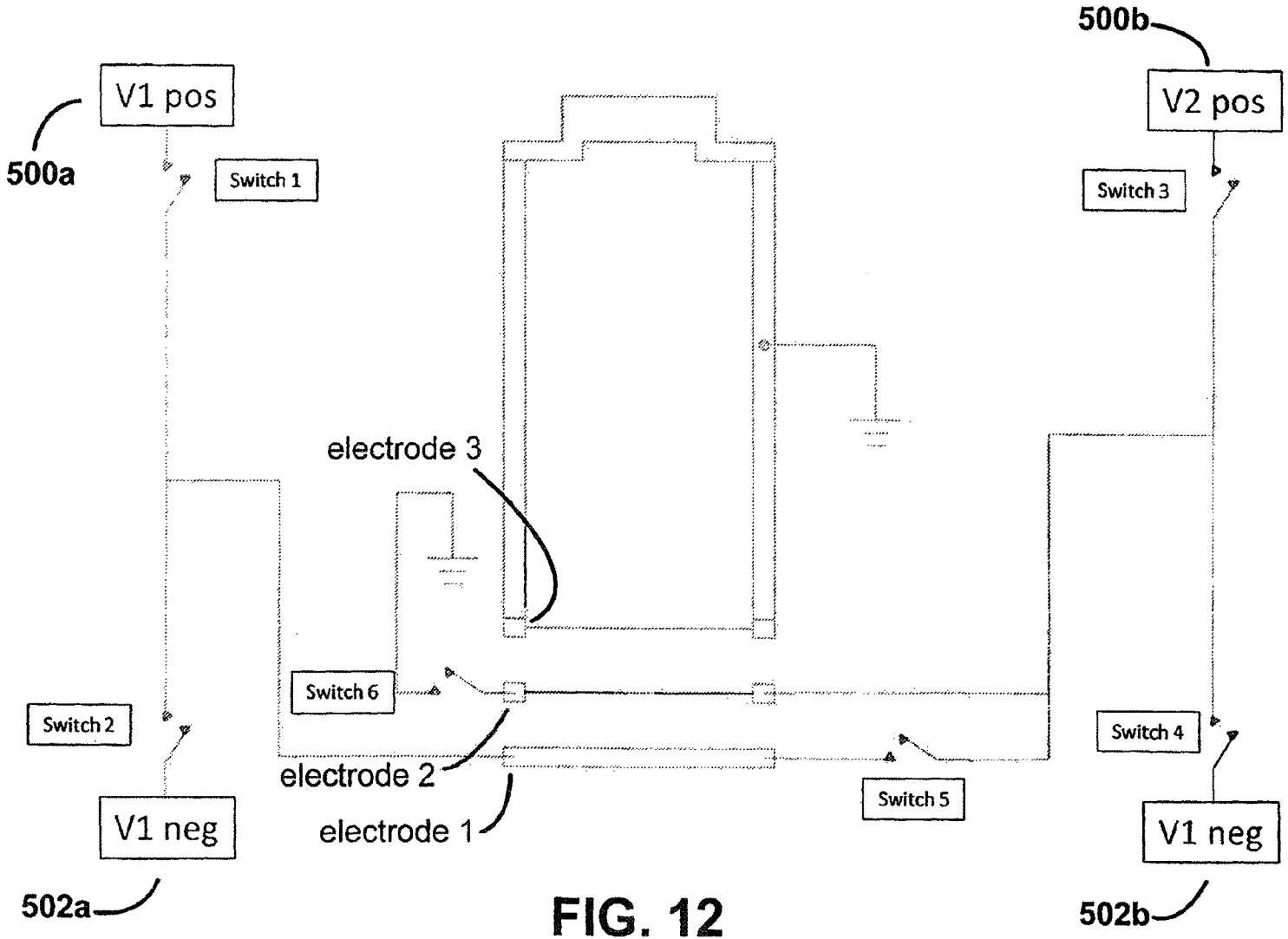
Figure 13:
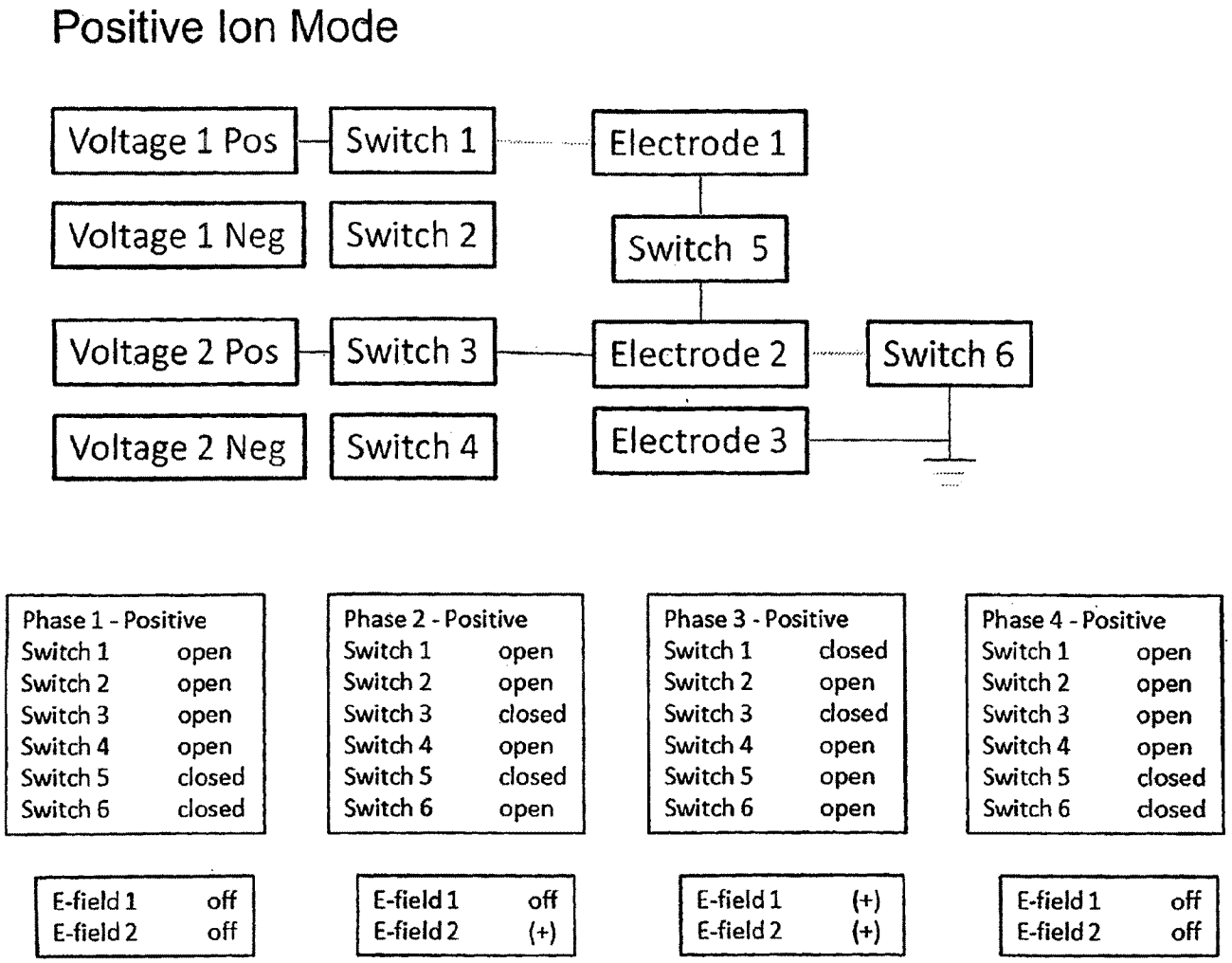

By way of additional example, FIG. 12 schematically depicts another embodiment of the pulser that includes two positive voltage sources 500*a*/500*b* and two negative voltage sources 502*a*/502*b* for applying voltages to the electrodes 1, 2 and 3 during cycles for detecting positive and negative ions. With reference to FIG. 13, in phase 1 of a cycle for detecting positive ions, the switches 5 and 6 are closed and the other switches are open to maintain each of the three electrodes at the ground electric potential. During phase 2 of this cycle, the switches 3 and 5 are closed and the other switches are open to apply the same positive voltage (i.e., positive V2) to the electrodes 1 and 2. During phase 3, the switches 1 and 3 are closed and the other switches are open to apply a voltage differential across the electrodes 1 and 2. During phase 4, the switches 5 and 6 are closed and the other switches are open to electrically couple each of the three electrodes to the electric ground, thereby generating field free regions between the electrodes 1 and 2 as well as between the electrodes 2 and 3.

Figure 14:
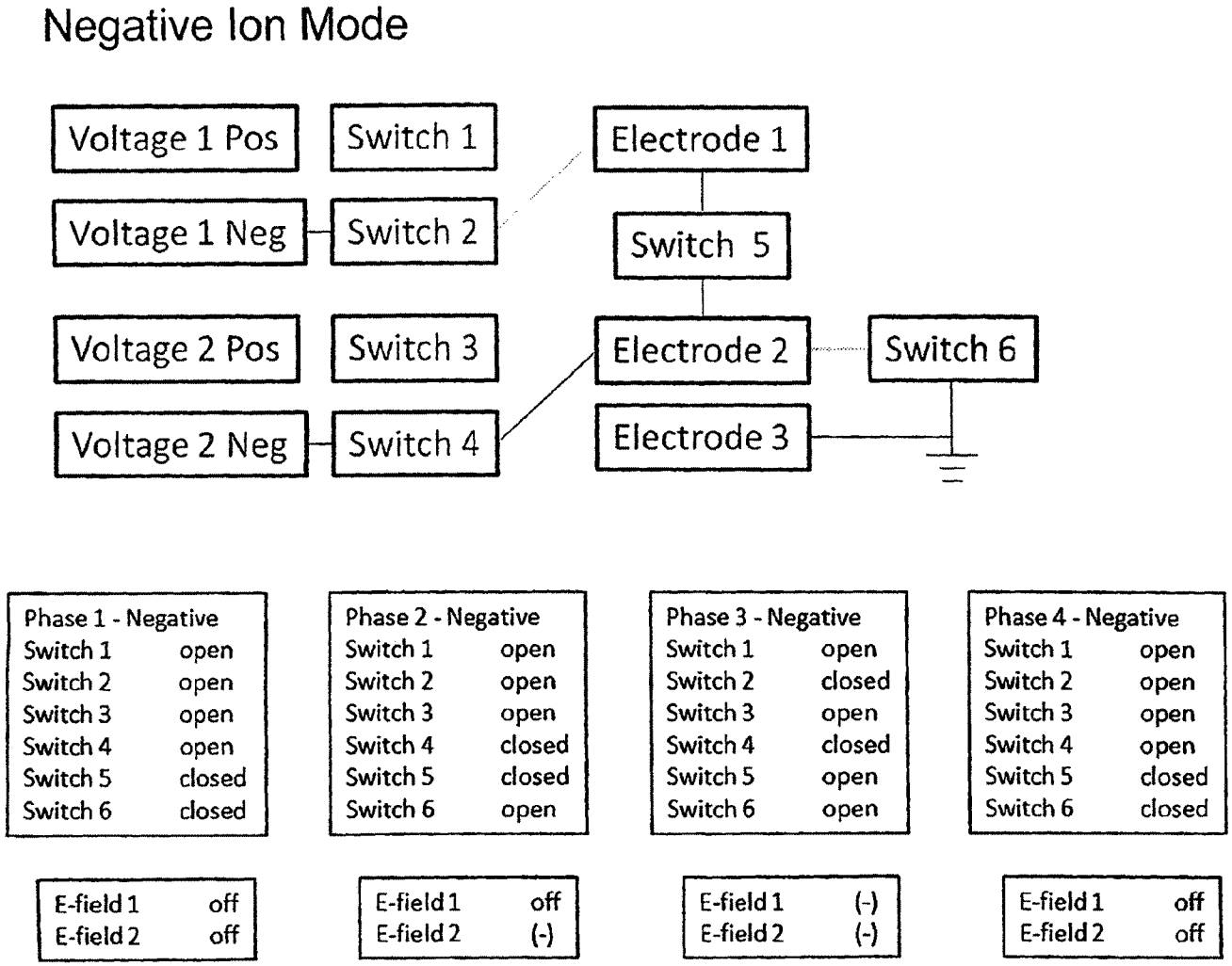

With reference to FIG. 12 and FIG. 14, in phase 1 of a cycle for detecting negative ions, the switches 5 and 6 are closed and the other switches are open to electrically couple each of the three electrodes to the ground electric potential. During phase 2, the switches 4 and 5 are closed and the other switches are open to apply the same negative voltage (i.e., negative V1) to the electrodes 1 and 2. During phase 3, the switches 2 and 4 are closed and the other switches are open to apply negative voltage V1 to the electrode 1 and negative voltage V2 to the electrode 2. During phase 4, the switches 5 and 6 are closed and the other switches are open to maintain each of the electrodes at the electric ground.

Figure 15:
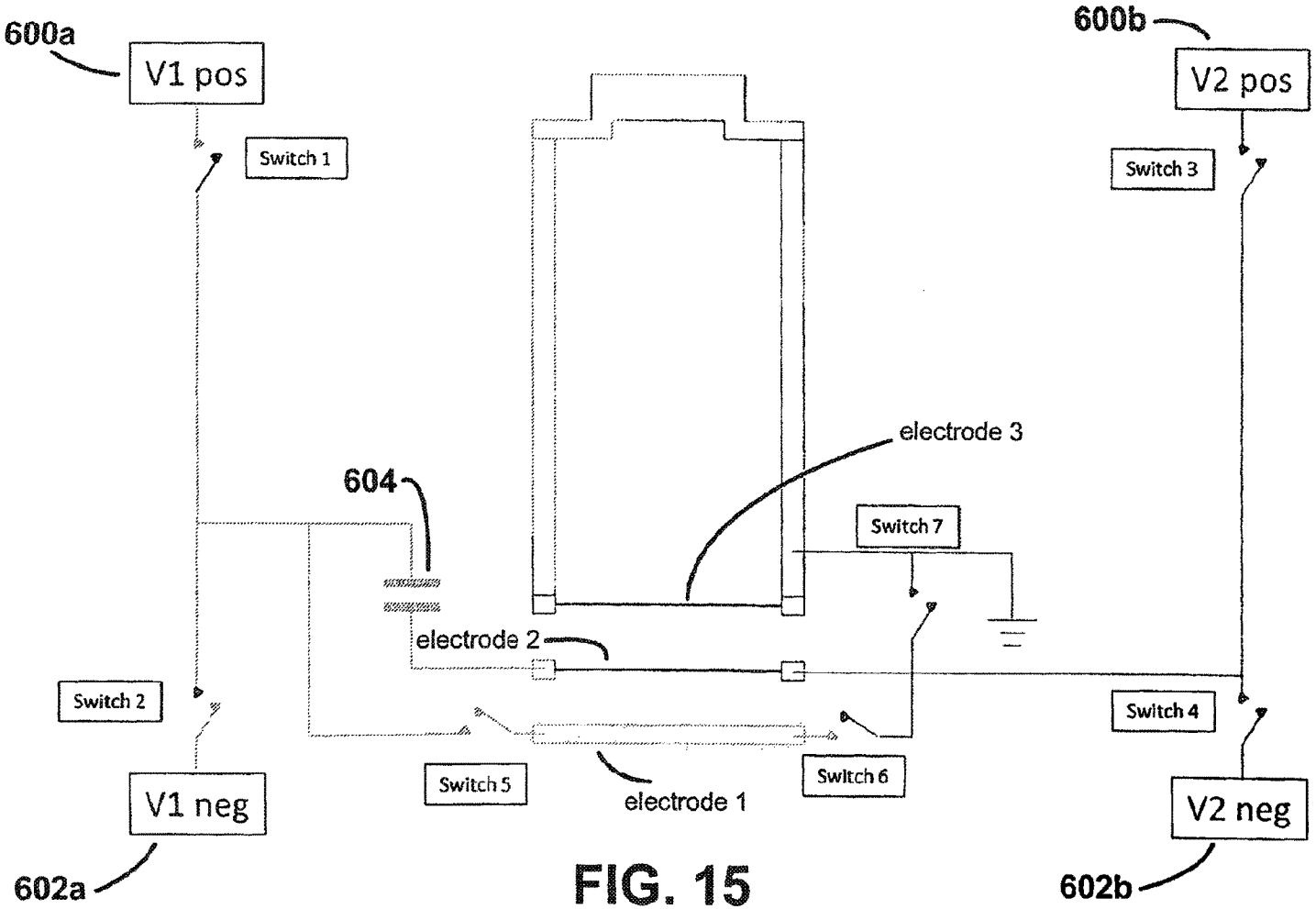

FIG. 15 illustrates another embodiment of the pulser that includes two positive voltage sources 600*a* and 600*b*, two negative voltage sources 602*a*, 602*b*, six switches, labeled as Switch 1 through Switch 6, as well as a capacitor 604. The capacitor 604 is electrically coupled at one terminal to the electrode 2 and can be coupled at its other terminal, via switches 1 and 2, to the positive voltage source 600*a* or the negative voltage source 602*a*, and can be coupled via switch 5 to one end of the electrode 1.

Figure 16:
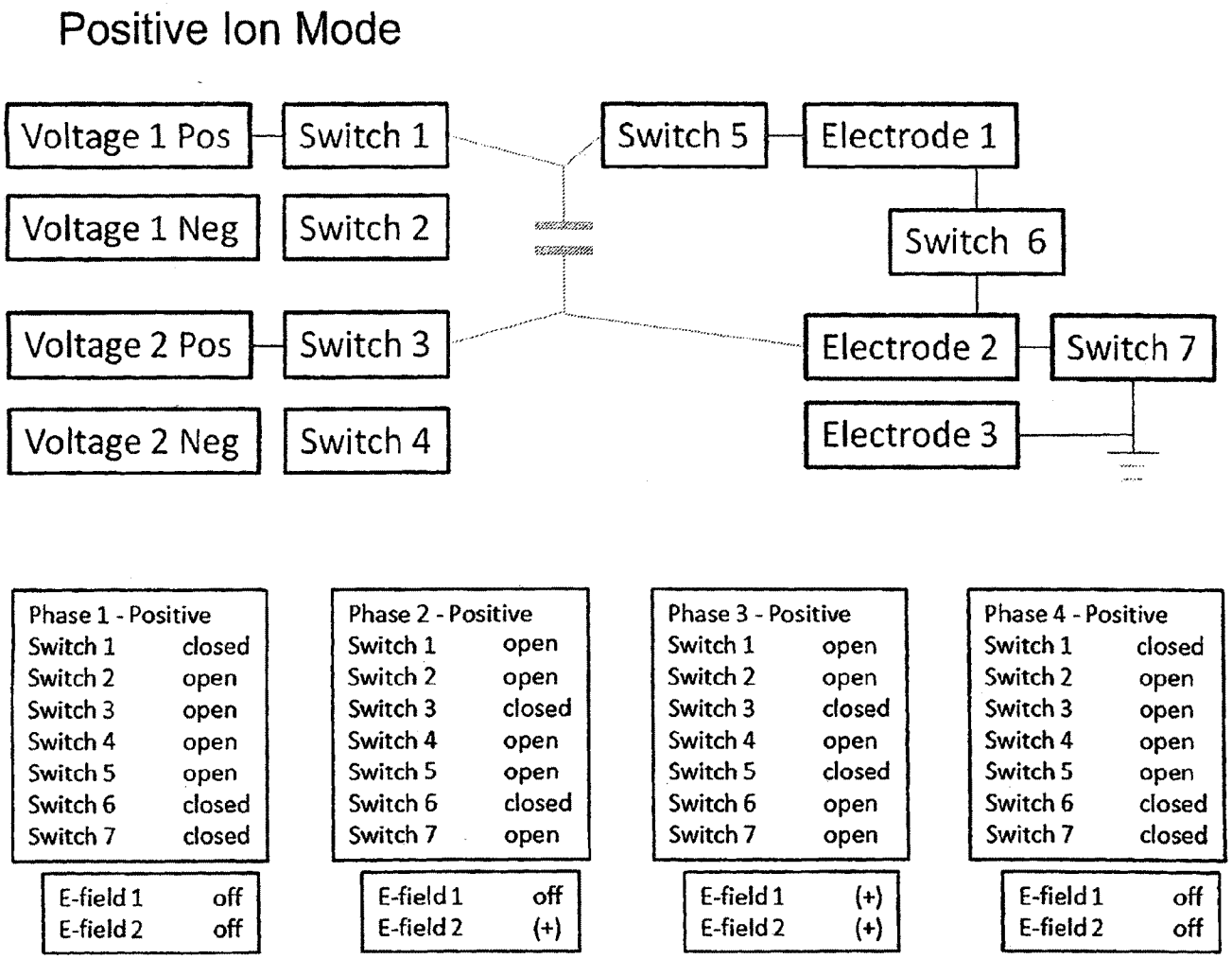

With reference to FIG. 15 as well as FIG. 16, during phase 1 of a cycle for detecting positive ions, the switches 1, 6 and 7 are closed and the other switches are open so as to maintain each of the electrodes 1, 2, and 3 at the ground electric potential (similar to the previous embodiments, the electrode 3 is maintained at the ground electric potential during all four phases of a detection cycle). Further, during this phase, the capacitor 604 is charged by the voltage source 600*a*. During phase 2, the switches 3 and 6 are closed and the other switches are open to apply the same positive voltage (namely positive V2) to the electrodes 1 and 2 During phase 3, the switches 3 and 5 are closed and the other switches are open to apply a voltage differential across the electrodes 1 and 2 for deflecting and accelerating the ions accumulated in the space between the electrodes 1 and 2. During this phase, the capacitor 604 functions as a voltage source to facilitate the application of a voltage differential across the electrodes 1 and 2. The voltage on electrode 1 will be the sum of the voltage delivered by both power supplies. During phase 4, the switches 1, 6 and 7 are closed and the other switches are open to maintain the electrodes 1 and 2 at the ground potential and to recharge the capacitor.

Figure 17:
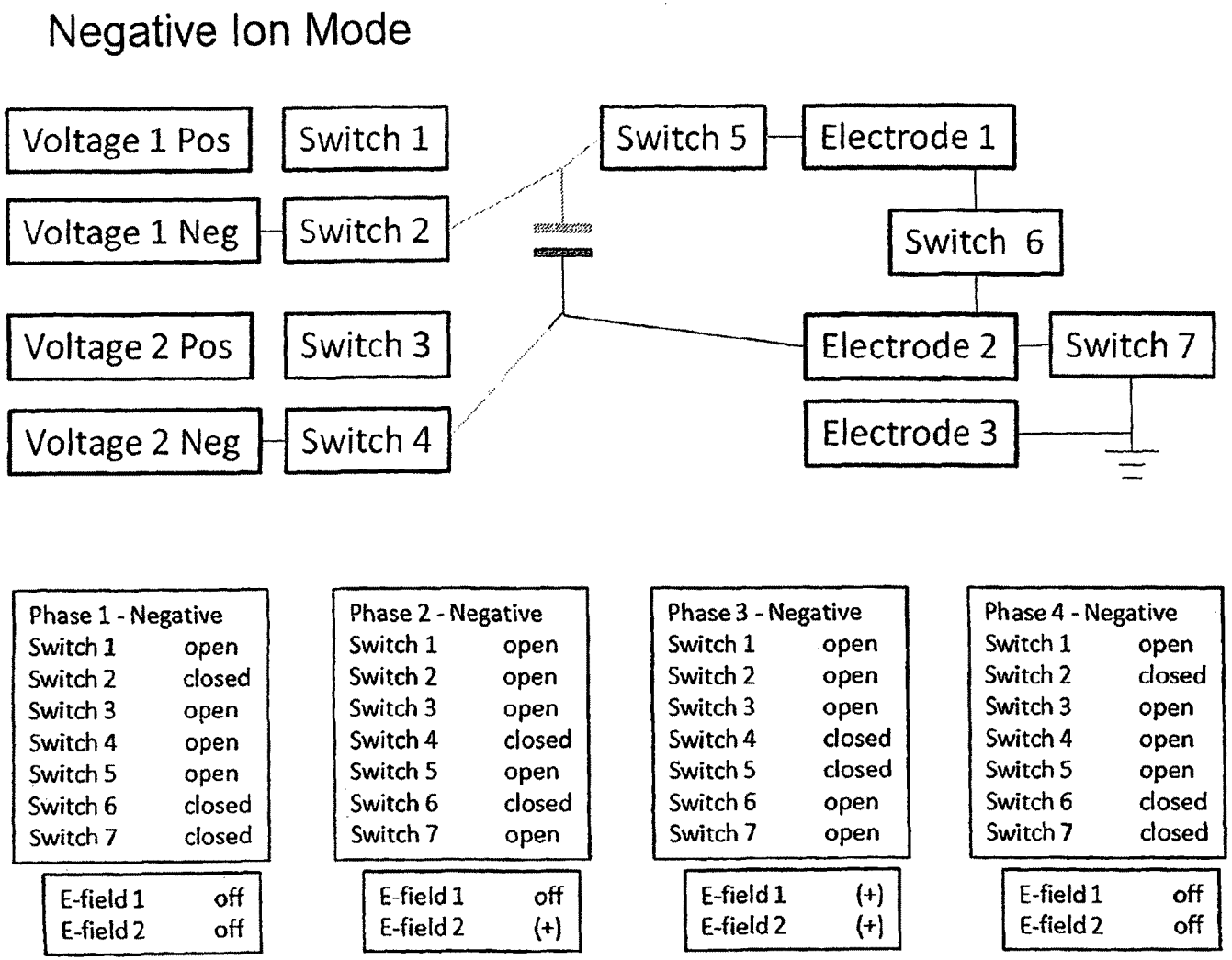

With reference to FIG. 15 and FIG. 17, during phase 1 of a cycle for detecting negative ions, the switches 2, 6 and 7 are closed and the other switches are open so as to maintain the electrodes 1 and 2 at the ground electric potential. During phase 2, the switches 4 and ≠are closed and the other switches are open to apply the same negative voltage (i.e., negative V2) to the electrodes 1 and 2 and to charge the capacitor 604. During phase 3, the switches 4 and 5 are closed and the other switches are open to apply a voltage differential across the electrodes 1 and 2. During this phase, the capacitor 604 functions as a voltage source to facilitate the application of a voltage differential across the electrodes 1 and 2. During phase 4, the switches 2, 6 and 7 are closed and the other switches are open to maintain the electrodes 1 and 2 at the ground electric potential. During this phase, the capacitor, which had been discharged (or at least partially discharged) during the previous phase, is recharged.

In some embodiments, the transition time between a cycle for detecting positive ions and an adjacent cycle for detecting negative ions can be in a range of about 10 microseconds to about 500 microseconds. In some embodiments, the teachings of the invention are incorporated in a linear TOF analyzer in which the flight times can be very short (e.g., on the order of about 10 microseconds), allowing a very high pulser frequency (e.g., a frequency greater than about 200 kHz) to capture a high percentage of ions. For some ions, the capture rate can be 100%. The capture rate can be mass dependent. For example, ions with a lower m/z than optimal m/z (i.e., the m/z for which the ion capture is 100%) will have a capture rate less than 100%, e.g., due to their high velocity. In some embodiments, the optimal pulser frequency can be chosen so that the target mass will pass across the accelerator during the time that is spent in phase 4 (i.e., complete overlap of phase 1 and phase 4). All ions with a mass-to-charge ratio greater than that of the target will be captured and accelerated. Some ions with a mass-to-charge ratio less than that of the target will be lost as some will pass completely through the accelerator and will exit the accelerator region.

Figure 18:
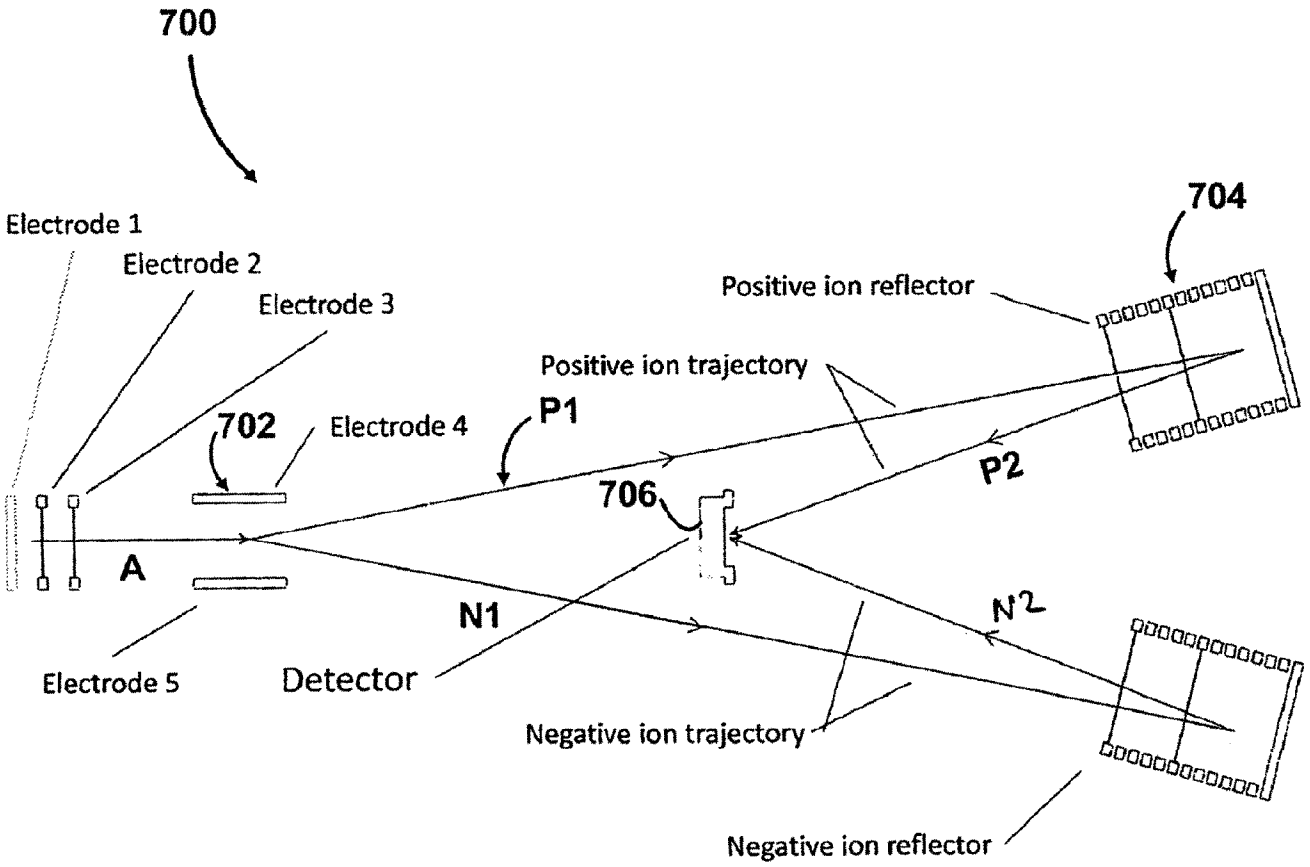

In some embodiments, the paths of the positive and negative ions can be separated within the TOF analyzer, e.g., via an electrostatic deflector, with the positive and negative ions paths culminating on a common detector for the detection of the ions. By way of example, FIG. 18 schematically depicts an exemplary implementation of such an embodiment of a TOF analyzer 700 according to the present teachings, which includes an accelerator stage comprising three electrodes 1, 2 and 3, which are implemented in a manner discussed above in connection with the previous embodiment. The ions enter the space between the electrodes 1 and 2 during an ion acceptance phase along a path generally perpendicular to the longitudinal axis (A) of the analyzer, and are deflected toward the longitudinal axis in a subsequent phase via a voltage differential applied between the electrodes 1 and 2. This voltage differential further accelerates the ions so that they would achieve a desired energy, e.g., in a range of about 1000 eV to about 15000 eV. As in the previous embodiments, the electrode 3 is maintained at the ground electric potential and the polarity of the voltages applied to the electrodes 1 and 2 can be switched, e.g., in a manner discussed above, such that positive ions and negative ions are accelerated and detected by a detector, as discussed in more detail below, in positive and negative ion cycles, respectively.

In this embodiment, the TOF analyzer 700 further includes an ion deflector 702 that is disposed downstream of the acceleration stage for receiving the accelerated ions. The ion deflector includes two opposed electrodes 4 and 5 that are spaced apart in a transverse direction relative to the longitudinal axis (A) to provide a space therebetween through which the ions can pass. A voltage differential, e.g., a DC voltage differential, applied to the electrodes 4 and 5 can generate an electric field in the space between these electrodes in a direction perpendicular to the propagation direction of the ions to deflect the positive ions along one trajectory (P1) and deflect the negative ions along a different trajectory (N1). The positive ions travel along the trajectory P1 through a field-free drift region to reach a positive ion mirror 704, which reflects those ions onto a path P2 within the field-free drift region that is directed toward an ion detector 706. The negative ions in turn travel along the trajectory Ni through the field-free drift region to reach a negative ion reflector, which reflects those ions onto a path N2 within the field-free region that is directed toward the ion detector 706. Hence, in this embodiment, a common ion detector is employed to detect both the positive and the negative ions during positive and negative ion cycles, respectively.

Figure 19:
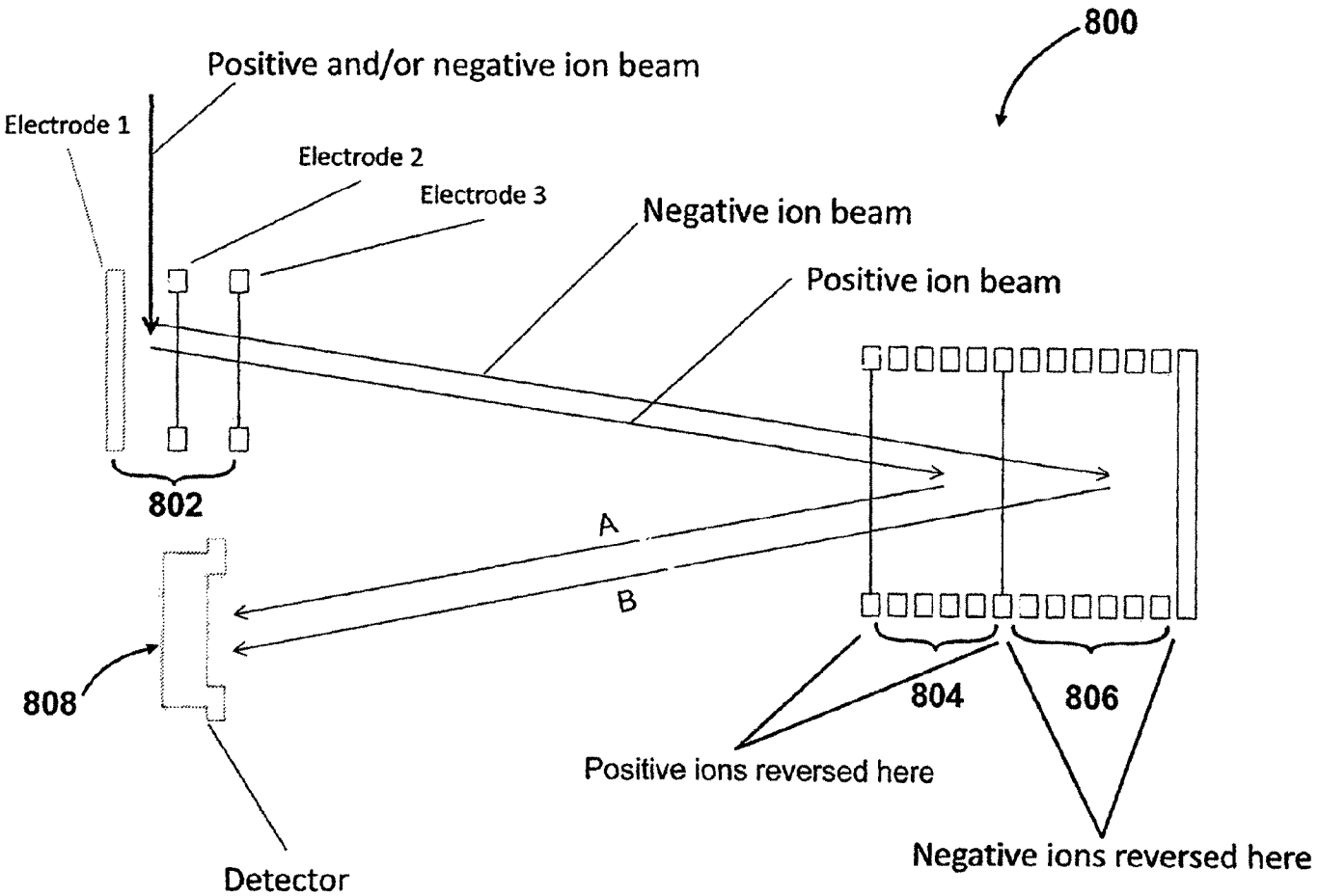

FIG. 19 schematically depicts another embodiment of a TOF analyzer 800 according to the present teachings that includes an acceleration stage 802, which comprises three electrodes 1, 2 and 3. These electrodes are implemented in a manner discussed above in connection with the previous embodiments and are configured to deflect and accelerate positive and negative ions accumulated in a space between the electrodes 1 and 2 toward a field-free drift chamber. In this embodiment, two ion mirrors 804 and 806 are disposed in tandem in the propagation paths of the ions between the acceleration stage 802 and an ion detector 808. The ion mirrors 804 and 806 are configured such that the first ion mirror (i.e., ion mirror 804) encountered by the ions reflects the positive ions and allows the negative ions pass therethrough, and the second ion mirror (i.e., ion mirror 806) reflects the negative ions after their passage through the first reflector. In other embodiments, the ion mirrors 804 and 806 can be positioned relative to one another such that the first ion mirror encountered by the ions would reflect the negative ions and the second ion mirror would reflect the positive ions toward the ion detector 808.

With continued reference to FIG. 19, the positive ions reflected by the ion mirror 804 propagate along a trajectory (A) to reach the detector, and the negative ions reflected by the ion mirror 806 propagate along a different trajectory (B) to reach the detector 808 The detector detects these ions to generate a mass spectrum in a manner known in the art. In some embodiments, the trajectory (A) and the trajectory (B) can be the same trajectory. In other words, the system can be configured such that the tandem mirrors would reflect the positive and negative ions in such a way that the ions of both polarities follow the same trajectory toward the detector.

Figure 20:
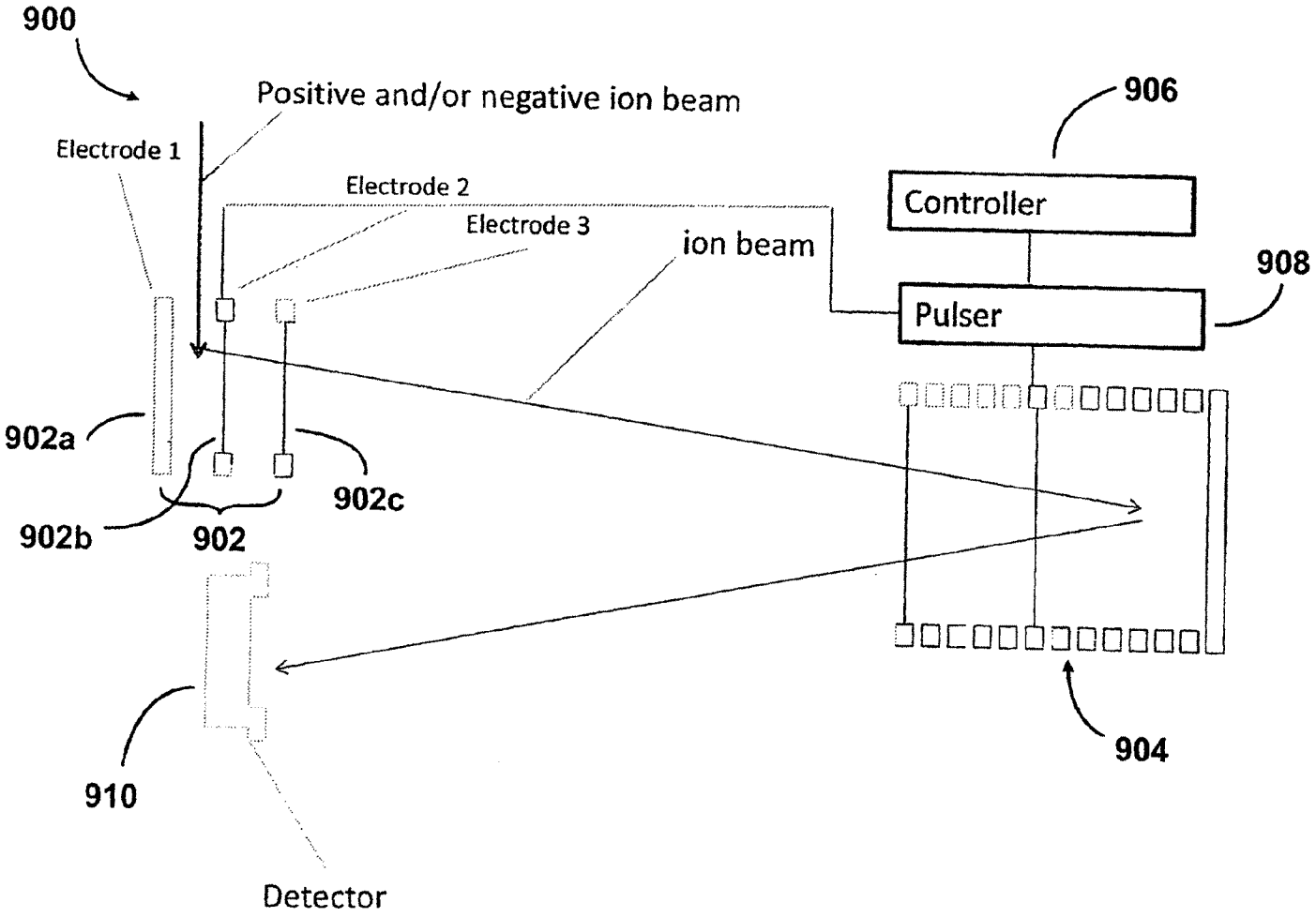

In some other embodiments, only a single ion mirror is employed and the ion mirror is controlled via a controller to provide reflection of positive and negative ions, respectively, during the cycles in which positive and negative ions are detected. By way of example, FIG. 20 schematically depicts such an embodiment of a TOF analyzer 900 having an accelerator stage 902 comprising electrodes 902*a*, 902*b*, and 902*c*, and an ion mirror 904. A controller 906 controls a pulser 908 for applying voltages to the electrodes of the accelerator to configure the accelerator for cycles of positive and negative ion detections, in a manner discussed above. In addition, the controller controls the pulser to configure the ion mirror to reflect positive or negative ions in synchrony with the accelerator. When the accelerator is configured to deflect and accelerate positive ions toward to a drift chamber of the analyzer, the controller instructs the pulser to apply appropriate voltages to the electrodes of the ion mirror 904 so that the ion mirror would reflect the positive ions that have passed through a portion of the drift chamber to pass through another portion of the drift chamber to reach an ion detector 910. When the accelerator is configured to deflect and accelerate negative ions, the controller instructs the pulser to configure the ion mirror (e.g., via application of appropriate voltages to its electrodes) to reflect negative ions toward the ion detector 910.

In some embodiments, rather than receiving ions directly from an ion source, the TOF analyzer can receive ions from upstream stages of the mass spectrometer. For example, in some embodiments, the mass spectrometer can be an MS/MS analyzer in which the TOF analyzer receives ions from an upstream quadrupole analyzer.

A mass spectrometer according to the present teachings can be employed in a variety of applications, such as mass spectroscopic detection of proteins, metabolites, food contaminants, environmental toxins in a shorter time period than achieved by conventional mass spectrometers.

U.S. Published Application No. 2013/0214148 entitled "Triple Switch Topology For Delivering Ultrafast Pulser Polarity Switching For Mass Spectrometry," is herein incorporated by reference in its entirety.

Those having ordinary skill in the art will appreciate that various modification can be made to the above embodiments without departing from the scope of the invention.

What is claimed is:

1. A mass spectrometer, comprising a time-of-flight (TOF) analyzer, comprising an accelerator stage comprising a plurality of electrodes and adapted to receive and accelerate a plurality of ions, a drift chamber disposed downstream of said accelerator stage for receiving at least a portion of the accelerated ions, a pulser coupled to the accelerator for applying one or more voltages to said plurality of electrodes, a controller coupled to the pulser and adapted to cause the pulser to adjust one or more voltages applied to said electrodes so as to configure the accelerator stage to receive and accelerate positive and negative ions during different cycles of an ion detection period, and an ion deflector disposed downstream of said accelerator stage so as to deflect accelerated positive and negative ions along different trajectories for passage through at least a portion of said drift chamber.

2. The TOF analyzer of claim 1, further comprising one of a positive ion mirror disposed downstream of said deflector and configured to receive the positive ions from said deflector and to reflect the received positive ions toward said ion detector and a negative ion mirror disposed downstream of said deflector and configured to receive the negative ions from said deflector and to reflect said received negative ions toward said ion detector.

3. A method of performing mass spectroscopy using a time-of-flight (TOF) analyzer, comprising:

providing an accelerator stage comprising a first electrode, a second electrode disposed downstream of the first electrode, and a third electrode downstream of the second electrode, configuring the accelerator stage of said TOF analyzer to receive and accelerate positive and negative ions during different,cycles for detecting positive and negative ions, passing the accelerated positive and negative ions during each of said cycles through a drift chamber, detecting at least a portion of the ions after their passage through the drift chamber in each of said cycles, maintaining said first and second electrodes at a ground electric potential during a first phase of a cycle for detecting positive ions so as to allow accumulation of a plurality of positive ions in a space between said first and second electrodes, applying equal positive voltages to said first and second electrodes during a second phase of said cycle so as to inhibit entrance of additional positive ions into the space between said first and the second electrodes and to create an electric field between the second and said third electrode, applying a voltage differential between said first and second electrodes during a third phase of said cycle so as to accelerate the ions accumulated in the space between the first and second electrodes toward said drift chamber, and maintaining said first and second electrodes at the end electric potential during a fourth phase of said cycle in which the accelerated ions pass through the drift chamber.

4. The method of claim 3, wherein at least one cycle for detecting ions of the first polarity has a partial temporal overlap with at least one cycle for detecting ions of the opposite polarity to the ions of the first polarity.

5. The method of claim 3, wherein said step of configuring said accelerator stage comprising switching polarity of one of more voltages applied to one or more electrodes of said accelerator.

6. The method of claim 3, further comprising providing at least one positive voltage source and at least one negative voltage source and a plurality of switches for selectively coupling said voltage sources to said plurality of electrodes.

7. The method of claim 6, wherein one or more said switches are selectively activated and deactivated to change polarity of one or more voltages applied to said one or more electrodes so as to configure said accelerator stage from a positive ion mode to a negative ion mode.

8. The method of claim 6, wherein said ion source supplies positive ions to said accelerator stage when the accelerator stage is in a positive ion mode and supplies negative ions to the accelerator stage when the accelerator stage is in a negative ion mode.

9. The method of claim 8, wherein said third electrode is disposed in proximity of an entrance of said drift chamber and wherein said third electrode is maintained at the electric ground potential.

10. The method of claim 3, wherein said fourth phase of said cycle has a temporal overlap with a first phase of a subsequent cycle for detecting ions.

11. The TOF analyzer of claim 3, wherein said first and second electrodes are maintained at the ground electric potential during a first phase of a cycle for detecting negative ions so as to allow accumulation of a plurality of negative ions in a space between said first and second electrodes.

12. The TOF analyzer of claim 11, wherein said controller causes the puiser to apply the same negative voltages to said first and second electrodes during a second phase of said cycle so as to inhibit entrance of additional negative ions into the space between the first and the second electrodes and to create an electric field between the second and third electrodes.

13. The TOF analyzer of claim 12, wherein said controller causes the voltage source to apply a voltage differential between said first and second electrodes during a third phase of said cycle so as to accelerate the negative ions accumulated in the space between the first and second electrodes toward said drift chamber.

14. The TOF analyzer of claim 13, wherein said controller causes the puller to maintain said first and second electrodes at the ground electric potential during a fourth phase of said cycle in which the accelerated negative ions pass through the drift chamber.

15. The method of claim 14, wherein said fourth phase of said cycle has a temporal overlap with a first phase of a subsequent cycle for detecting ions.

* * * * *